US007783234B2

(12) United States Patent
Okamoto et al.

(10) Patent No.: US 7,783,234 B2
(45) Date of Patent: Aug. 24, 2010

(54) DEVELOPER CARTRIDGE, IMAGE FORMING APPARATUS, AND SHUTTER DEVICE

(75) Inventors: Katsumi Okamoto, Azumino (JP); Toshiaki Oshima, Matsumoto (JP); Kazuhiro Ichikawa, Okaya (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 437 days.

(21) Appl. No.: 11/772,715

(22) Filed: Jul. 2, 2007

(65) Prior Publication Data

US 2008/0124105 A1 May 29, 2008

(30) Foreign Application Priority Data

Jul. 4, 2006 (JP) ..... 2006-184708
Jul. 4, 2006 (JP) ..... 2006-184709
Jul. 4, 2006 (JP) ..... 2006-184710

(51) Int. Cl.
*G03G 15/08* (2006.01)

(52) U.S. Cl. ..... 399/260; 399/106; 399/262

(58) Field of Classification Search ..... 399/106, 399/258, 260, 262, 263
See application file for complete search history.

(56) References Cited

U.S. PATENT DOCUMENTS 5,630,198 A 5/1997 Makino
5,678,147 A 10/1997 Makino
5,697,014 A 12/1997 Makino
5,761,585 A 6/1998 Makino
5,771,427 A 6/1998 Makino
6,185,401 B1 2/2001 Kanamori et al.
6,438,345 B1 * 8/2002 Ban et al. ..... 399/262
7,111,654 B2 * 9/2006 Takagi ..... 141/351
7,266,330 B2 9/2007 Murakami et al.
7,426,363 B2 9/2008 Murakami et al.
7,450,890 B2 11/2008 Murakami et al.
2005/0135841 A1 6/2005 Murakami et al.
2006/0104671 A1 5/2006 Murakami et al.
2008/0013988 A1 1/2008 Murakami et al.
2008/0260422 A1 10/2008 Sasae et al.

FOREIGN PATENT DOCUMENTS

EP 0793149 A1 9/1997
EP 0805379 A1 11/1997
EP 0905577 A2 3/1999
EP 1437632 A1 7/2004
EP 1533664 A1 11/2004
EP 1528439 A1 5/2005
EP 1659455 A2 5/2006
JP 63086652 U 6/1988
JP 06-208299 7/1994
JP 08-146734 6/1996

(Continued)

*Primary Examiner*—Hoang Ngo
(74) *Attorney, Agent, or Firm*—Hogan & Hartson LLP

(57) ABSTRACT

A developer cartridge, including: a container for containing developer; a shutter that is supported so that the shutter can linearly move relative to the container, and that opens and closes by moving linearly; a handle member that is supported so that the handle member can rotationally move relative to the container, and that includes a handle; and a conversion mechanism by which rotational-movement force that rotationally moves the handle member is converted into linear-movement force that linearly moves the shutter.

20 Claims, 15 Drawing Sheets

FOREIGN PATENT DOCUMENTS

| | | | |
|---|---|---|---|
| JP | 08305148 | A | 11/1996 |
| JP | 10055103 | A | 2/1998 |
| JP | 11-194600 | | 7/1999 |
| JP | 11-282233 | | 10/1999 |
| JP | 2000-098724 | | 4/2000 |
| JP | 2001-083788 | | 3/2001 |
| JP | 2001201925 | A | 7/2001 |
| JP | 2002-091144 | | 3/2002 |
| JP | 2003-107892 | | 4/2003 |
| JP | 2003107892 | A | 4/2003 |
| JP | 2005173568 | A | 6/2005 |
| JP | 2005-326869 | | 11/2005 |
| JP | 2006-084844 | | 3/2006 |
| JP | 2006163374 | A | 6/2006 |
| WO | 2006052005 | A2 | 5/2006 |

* cited by examiner

DEVELOPER CARTRIDGE, IMAGE FORMING APPARATUS, AND SHUTTER DEVICE

CROSS-REFERENCE TO RELATED APPLICATIONS

The present application claims priority from Japanese Patent Application No. 2006-184708 filed on Jul. 4, 2006, Japanese Patent Application No. 2006-184709 filed on Jul. 4, 2006, and Japanese Patent Application No. 2006-184710 filed on Jul. 4, 2006, which are herein incorporated by reference.

BACKGROUND

1. Technical Field

The invention relates to developer cartridges, image forming apparatuses and shutter devices.

2. Related Art

An image forming apparatus such as a laser beam printer has been well-known. Such an image forming apparatus includes, for example, an image-bearing body that bears a latent image, and a developing section that makes the latent image borne by the image-bearing body visible using developer as a developer image. When image signals, etc. are transmitted from such external devices as a computer, the image forming apparatus makes a latent image borne by the image-bearing body visible as a developer image using the developing section, and transfers this developer image onto a medium and finally forms an image on the medium.

Further, the image forming apparatus has a developer cartridge for supplying the developing section with developer. The developer cartridge includes, for example, a shutter that opens and closes and a container for containing developer; when the shutter opens, developer inside the container is supplied to the developing section. In addition, the developer cartridge can be attached to and detached from an image-forming-apparatus body, and includes a handle member for grabbing the developer cartridge in attaching/detaching of the developer cartridge.

By the way, in order to move developer inside the container to the outside thereof (for example, to supply the developing section with the developer), it is necessary to properly open and close the shutter. On the other hand, if a complicated mechanism is provided in order to properly open and close the shutter, there is a risk that it induces increase of the number of components. Therefore, there is a need for a method that allows a simple configuration to properly open and close the shutter.

Furthermore, among image forming apparatuses are those including: a first opening and a second opening that are provided opposing each other and through which developer can pass; a first shutter that can move between a first closing position at which the first shutter covers the first opening and a first opening position at which the first shutter exposes the first opening; and a second shutter that can move between a second closing position at which the second shutter covers the second opening and a second opening position at which the second shutter exposes the second opening. Besides, the first shutter and the second shutter are provided adjacent to each other between the first opening and the second opening; developer can pass through the first opening and the second opening when the first shutter is located at the first opening position and the second shutter is located at the second opening position.

By the way, as a configuration which to open and close the first shutter and the second shutter, two configurations are proposed: one is a configuration in which the first shutter and the second shutter each move and open/close independently, and the other is a configuration in which one of the two shutters moves and opens/closes in conjunction with movement of the other shutter.

However, the former of the above-mentioned two configurations is likely to induce increase of the number of components. On the other hand, in the latter configuration, movement of two shutters is likely to be restricted. For example, assume that one of the two shutters presses the other one and moves from its opening position to its closing position. In such a case, the other shutter is pressed by the one shutter, and thereby the other shutter moves from its opening position to its closing position. Therefore, the two shutters stops simultaneously, and this restricts movement of the two shutters.

Moreover, among image forming apparatuses are those including a shutter device that can open and close. The shutter device is for allowing and restricting movement of developer between two units, for example. The shutter device includes a sealing member that includes an opening through which developer can pass and that is for preventing developer from spilling, and a shutter that can move between a first position at which the shutter covers the opening of the sealing member and a second position at which the shutter exposes the opening of the sealing member; the sealing member prevents developer from spilling while being pressed by the shutter. When the shutter moves to and is located at the second position (that is, when the shutter opens), developer can move between the above-mentioned two units.

However, there is a risk that the sealing member cannot sufficiently prevent spillage of developer when the shutter is located at the second position (that is, when the shutter opens).

For example, if, when opening, the shutter presses (compresses) only a part of the circumferential section of the opening of the sealing member, a section at which the thickness of the sealing member changes steeply will be formed in the circumferential section of the opening. There is a risk that, when the shutter opens, this causes a gap to be formed between the sealing member and an opposing member that the sealing member opposes, and that developer that is moving between the above-mentioned two units spills from the gap.

Note that JP-A-2001-83788 is an example of the related art.

SUMMARY

An advantage of some aspects of the invention is that it is possible to realize a developer cartridge enabling a shutter to properly open and close in a simple configuration.

An aspect of the invention is the following developer cartridge.

A developer cartridge, including:

- a container for containing developer;
- a shutter that is supported so that the shutter can linearly move relative to the container, and that opens and closes by moving linearly;
- a handle member that is supported so that the handle member can rotationally move relative to the container, and that includes a handle; and
- a conversion mechanism by which rotational-movement force that rotationally moves the handle member is converted into linear-movement force that linearly moves the shutter.

Another advantage of some aspects of the invention is that it is possible to realize an image forming apparatus enabling a first shutter and a second shutter to properly open and close in a simple configuration.

Another aspect of the invention is the following image forming apparatus.

An image forming apparatus, including:

a first opening and a second opening that are provided opposing each other, and through which developer can pass;

a first shutter and a second shutter that are provided adjacent to each other between the first opening and the second opening, the first shutter being capable of moving between a first closing position at which the first shutter covers the first opening and a first opening position at which the first shutter exposes the first opening, the second shutter being capable of moving between a second closing position at which the second shutter covers the second opening and a second opening position at which the second shutter exposes the second opening, and the second shutter including an operating section that engages with the first shutter and operates the first shutter, and whose engagement with the first shutter is disengaged at a certain point during at least either one of opening movement from the second closing position to the second opening position and closing movement from the second opening position to the second closing position.

Another advantage of some aspects of the invention is that it is possible to realize a shutter device enabling to sufficiently prevent developer from spilling.

Another aspect of the invention is the following shutter device.

A shutter device, including:

a sealing member that includes an opening through which developer can pass, and that is for preventing the developer from spilling; and a shutter that includes an opening being larger than an opening of the sealing member, that can move between a first position at which the shutter covers the opening of the sealing member and a second position at which the shutter exposes the opening of the sealing member, and that, when being located at the second position, presses the sealing member in a state where an entire edge section, of the shutter, around its opening surrounds an entire edge section, of the sealing member, around its opening.

Other features of the invention will become clear by the accompanying drawings and the description hereinbelow.

BRIEF DESCRIPTION OF THE DRAWINGS

For a more complete understanding of the invention and the advantages thereof, reference is now made to the following description taken in conjunction with the accompanying drawings.

DESCRIPTION OF EXEMPLARY EMBODIMENTS

Figure 1:
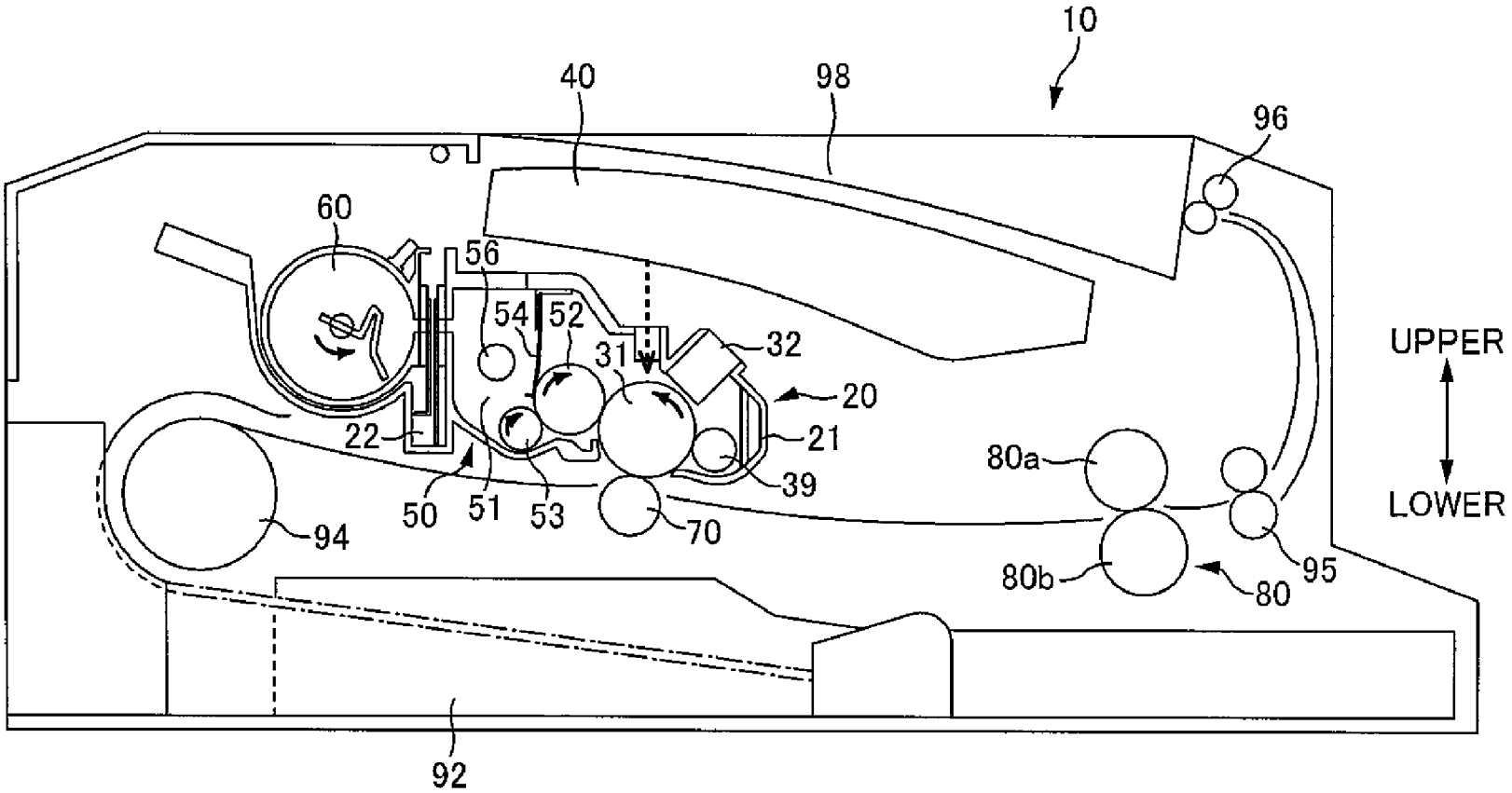
FIG. 1 is a diagram showing main components structuring a printer 10.

At least the following matters will be made clear by the description in the present specification and the accompanying drawings.

A developer cartridge, including:

a container for containing developer;

a shutter that is supported so that the shutter can linearly move relative to the container, and that opens and closes by moving linearly;

a handle member that is supported so that the handle member can rotationally move relative to the container, and that includes a handle; and a conversion mechanism by which rotational-movement force that rotationally moves the handle member is converted into linear-movement force that linearly moves the shutter.

With this developer cartridge, the rotational-movement force that rotationally moves the handle member is utilized through the conversion mechanism and linearly moves the shutter so that the shutter opens and closes. Accordingly, this allows the shutter to open and close properly in a simple configuration.

In addition thereto, the conversion mechanism may include a rack section that is provided to the shutter, and a pinion section that is provided to the handle member and that can engage with the rack section; and the shutter may move linearly as a result that the rotational-movement force is converted into the linear-movement force due to the handle member moving rotationally in a state where the rack section and the pinion section are engaged with each other.

If the conversion mechanism includes the rack section and the pinion section, it is possible to easily convert the rotational-movement force into the linear-movement force.

In addition thereto, the shutter may be made of metal; the handle member may be made of resin; the rack section may consist of a plurality of holes that are provided at regular intervals; and the pinion section may consist of a plurality of projections that are provided at regular intervals and that can engage with the holes.

If the shutter is made of metal, holes are easier to be processed than projections. Therefore, if the rack section consists of holes, it is possible to easily form the rack section.

An image forming apparatus, including:

an image-forming-apparatus body; and a developer cartridge that can be attached to and be detached from the image-forming-apparatus body, and that includes a container for containing developer, a shutter that is supported so that the shutter can linearly move relative to the container, and that opens and closes by moving linearly, a handle member that is supported so that the handle member can rotationally move relative to the container, and that includes a handle, and a conversion mechanism by which rotational-movement force that rotationally moves the handle member is converted into linear-movement force that linearly moves the shutter.

With this image forming apparatus, the rotational-movement force that rotationally moves the handle member is utilized through the conversion mechanism and linearly moves the shutter so that the shutter opens and closes. Accordingly, this allows the shutter to open and close properly in a simple configuration.

In addition thereto, the developer cartridge may include a handle-member locking section for locking the handle member so that the handle member cannot rotationally move relative to the container; the image-forming-apparatus body may include an unlocking section for releasing the locking between the handle member and the container, and a cartridge-inserted section into which the developer cartridge is inserted; when the developer cartridge is not inserted into the cartridge-inserted section, the locking by the handle-member locking section may restrict the rotational movement of the handle member relative to the container; and when the developer cartridge is inserted into the cartridge-inserted section, the locking may be released by the unlocking section so that the rotational movement of the handle member is allowed.

If the developer cartridge includes the handle-member locking section and the image-forming-apparatus body includes the unlocking section, it is possible to realize a simple configuration which can surely prevent the handle member from rotating incorrectly when the developer cartridge is not inserted into cartridge-inserted section.

In addition thereto, the handle-member locking section may include a protruding section that is provided on the handle member, and a fastening section that is provided to the container and that can fasten the protruding section; the unlocking section may be a projection portion that deforms the protruding section by contacting the protruding section; when the developer cartridge is not inserted into the cartridge-inserted section, the protruding section may be fastened by the fastening section; and when the developer cartridge is inserted into the cartridge-inserted section, the projection portion may deform the protruding section so that the fastening of the protruding section by the fastening section is released.

If the handle-member locking section includes the protruding section and the fastening section, and if the unlocking section is the projection portion, the protruding section can be easily fastened by the fastening section and the fastening of the protruding section by the fastening section can be easily released. Accordingly, it is possible to realize a simple configuration that can lock the handle member to the container and that can release the locking between the handle member and the container.

In addition thereto, the developer cartridge may be attached to the image-forming-apparatus body by rotationally moving the handle member to a predetermined position after the developer cartridge is inserted into the cartridge-inserted section; the image forming apparatus may include a container-locking section that is for locking the container to the cartridge-inserted section; and the container-locking section may include a hook that is provided to the handle member, and that moves with rotational movement of the handle member, and a hole section that is provided in the cartridge-inserted section, and through which the hook can move when the developer cartridge is inserted into the cartridge-inserted section and through which the hook cannot move when the developer cartridge is attached to the image-forming-apparatus body.

If the container-locking section includes the hook and the hole section, it is possible to realize a simple configuration which can lock the container to the cartridge-inserted section and release the locking between the container and the cartridge-inserted section.

An image forming apparatus, including:

a first opening and a second opening that are provided opposing each other, and through which developer can pass;

a first shutter and a second shutter that are provided adjacent to each other between the first opening and the second opening, the first shutter being capable of moving between a first closing position at which the first shutter covers the first opening and a first opening position at which the first shutter exposes the first opening, the second shutter being capable of moving between a second closing position at which the second shutter covers the second opening and a second opening position at which the second shutter exposes the second opening, and the second shutter including an operating section that engages with the first shutter and operates the first shutter, and whose engagement with the first shutter is disengaged at a certain point during at least either one of opening movement from the second closing position to the second opening position and closing movement from the second opening position to the second closing position.

With this image forming apparatus, it is possible to realize, without increasing the number of components, a simple configuration in which the first shutter and the second shutter can properly open and close.

In addition thereto, the image forming apparatus may include an image-forming unit that includes an image-bearing body for bearing a latent image, a containing section for containing developer, and a developer-bearing body for making the latent image borne by the image-bearing body visible using the developer as a developer image, and a developer cartridge that can be attached to and detached from the image-forming unit, and that is for supplying the containing section with the developer; the first opening and the first shutter may be provided to the image-forming unit; and the second opening and the second shutter may be provided to the developer cartridge.

If the first opening and the first shutter are provided to the image-forming unit, and if the second opening and the second shutter are provided to the developer cartridge, when, for example, the developer cartridge contains a small amount of developer, the developer cartridge is frequently attached and detached so that the two shutters frequently open and close. In such a case, if the operating section is provided, an effect that the two shutters can properly open and close in a simple configuration is achieved more effectively.

In addition thereto, the operating section may engage with the first shutter by elastic deformation of the operating section, and the operating section that engages with the first shutter may be disengaged from the first shutter by elastic deformation of the operating section.

In such a case, it is possible to realize a simple configuration in which the operating section can engage with the first shutter and the operating section engaging with the first shutter can be disengaged from the first shutter.

In addition thereto, a longitudinal direction of the first shutter may be along a longitudinal direction of the second shutter; the operating section may be an elastic metal piece that is located near both ends of the second shutter in its longitudinal direction; the first shutter may have an engaged-hole section with which the operating section can engage near both ends of the first shutter in its longitudinal direction; the developer cartridge may include a protrusion that pushes the operating section so as to project towards the first shutter when the second shutter moves; and the operating section may project towards the first shutter and can engage with the engaged-hole section when being pushed by the protrusion, and the operating section does not have to project and may be unable to engage with the engaged-hole section when not being pushed by the protrusion.

In the event that the operating section is an elastic metal piece, that the first shutter has the engaged-hole section with which the operating section can engage, and that the operating section engages with the engaged-hole section as a result of being pushed by the protrusion, it is possible to realize a simple configuration in which the operating section can engage with the second shutter.

In addition thereto, the second shutter may have a contacting section that can contact the first shutter when moving from the second closing position to the second opening position; and the first shutter may move from the first closing position to the first opening position as a result that the contacting section contacts and pushes the first shutter when the second shutter moves.

In addition thereto, a longitudinal direction of the first shutter may be along a longitudinal direction of the second shutter; the contacting section may be an extending section that extends towards the first shutter at one end in a transverse direction of the second shutter; the first shutter may have a projecting section that is located on a central section in the longitudinal direction of the first shutter and that projects towards the second shutter; and the first shutter may move from the first closing position to the first opening position as a result that the extending section contacts and pushes one end of the projecting section in a transverse direction of the first shutter when the second shutter moves.

In such a case, since the contacting section contacts the first shutter surely, the first shutter can surely move from the first closing position to the first opening position.

A shutter device, including:

a sealing member that includes an opening through which developer can pass, and that is for preventing the developer from spilling; and a shutter that includes an opening being larger than the opening of the sealing member, that can move between a first position at which the shutter covers the opening of the sealing member and a second position at which the shutter exposes the opening of the sealing member, and that, when being located at the second position, presses the sealing member in a state where an entire edge section, of the shutter, around its opening surrounds an entire edge section, of the sealing member, around its opening.

With this shutter device, the shutter includes the opening being larger than the opening of the sealing member, and, when being located at the second position, presses the sealing member in a state where the entire edge section, of the shutter, around its opening surrounds the entire edge section, of the sealing member, around its opening. Accordingly, the circumferential section of the opening of the sealing member contacts an opposing member properly. Therefore, a gap is less likely to be formed between the sealing member and the opposing member, and it is possible to sufficiently prevent developer from spilling.

An image forming apparatus, including:

a shutter device including:

a sealing member that includes an opening through which developer can pass, and that is for preventing the developer from spilling; and a shutter that includes an opening being larger than an opening of the sealing member, that can move between a first position at which the shutter covers the opening of the sealing member and a second position at which the shutter exposes the opening of the sealing member, and that, when being located at the second position, presses the sealing member in a state where an entire edge section, of the shutter, around its opening surrounds an entire edge section, of the sealing member, around its opening.

With this image forming apparatus, the shutter includes the opening being larger than the opening of the sealing member, and, when being located at the second position, presses the sealing member in a state where the entire edge section, of the shutter, around its opening surrounds the entire edge section, of the sealing member, around its opening. Accordingly, the circumferential section of the opening of the sealing member contacts an opposing member properly. Therefore, a gap is less likely to be formed between the sealing member and the opposing member, and it is possible to sufficiently prevent developer from spilling.

In addition thereto, the image forming apparatus may include two of the shutter devices; the two shutter devices may be provided adjacent to each other such that developer can move between the opening of the sealing member of one shutter device and the opening of the sealing member of the other shutter device when each of the shutters is located at the second position; and the sealing members that are pressed by their respective shutters may contact each other when the shutters of the two shutter devices are located at the second position.

In such a case, it is possible to sufficiently prevent spillage of developer that passes through between the two shutter devices.

In addition thereto, the edge sections, of the respective sealing members, around their respective openings that are pressed by their respective shutters may be sandwiched between the two shutters of the two shutter devices when the two shutters are located at the second position.

In such a case, it is possible to effectively prevent developer from spilling from between the two shutters.

In addition thereto, the two shutter devices may be a first shutter device provided to an image-forming unit that includes an image-hearing body for bearing a latent image, a containing section for containing developer, and a developer-bearing body for making the latent image borne by the image-bearing body visible using the developer as a developer image, and a second shutter device provided to a developer cartridge that can be attached to and detached from the image-forming unit, and that is for supplying the containing section with the developer.

If the two shutter devices are provided to the image-forming unit and the developer cartridge, an amount of developer passing through between the two shutter devices increases. Therefore, it is possible to more effectively achieve an effect generated by providing the shutter devices, that is, an effect that developer is sufficiently prevented from spilling.

In addition thereto, the shutter of the first shutter device may include a contacting section that contacts the shutter of the second shutter device when the shutter of the first shutter device moves from the first position to the second position; and when the shutter of the first shutter device moves from the second position to the first position, the contacting section does not have to reach a position opposite to the opening of the sealing member of the first shutter device.

In such a case, it is possible to prevent the shutter of the second shutter device from being dirtied by the contacting section of the first shutter device.

An image forming apparatus, including:

a developer cartridge including a container for containing developer, a sealing member that includes a second opening through which developer can pass, and that is for preventing developer from spilling, a second shutter that includes an opening being larger than the second opening, that opens and closes by moving linearly relative to the container between a second closing position at which the second shutter covers the second opening and a second opening position at which the second shutter exposes the second opening, and that, when being located at the second opening position, presses the sealing member in a state where an entire edge section, of the second shutter, around its opening surrounds an entire edge section, of the sealing member, around the second opening, a handle member that is supported so that the handle member can rotationally move relative to the container, and that includes a handle, and a conversion mechanism by which rotational-movement force that rotationally moves the handle member is converted into linear-movement force that linearly moves the second shutter;

a first opening that is provided opposing the second opening, and through which developer can pass; and a first shutter that is provided adjacent to the second shutter between the first opening and the second opening, and that opens and closes by moving between a first closing position at which the first shutter covers the first opening and a first opening position at which the first shutter exposes the first opening;

the second shutter including an operating section that engages with the first shutter and operates the first shutter, and whose engagement with the first shutter is disengaged at a certain point during at least either one of opening movement from the second closing position to the second opening position and closing movement from the second opening position to the second closing position.

With this image forming apparatus, an advantage of some aspects of the invention can be achieved more effectively.

Outline of Image Forming Apparatus

Figure 2:
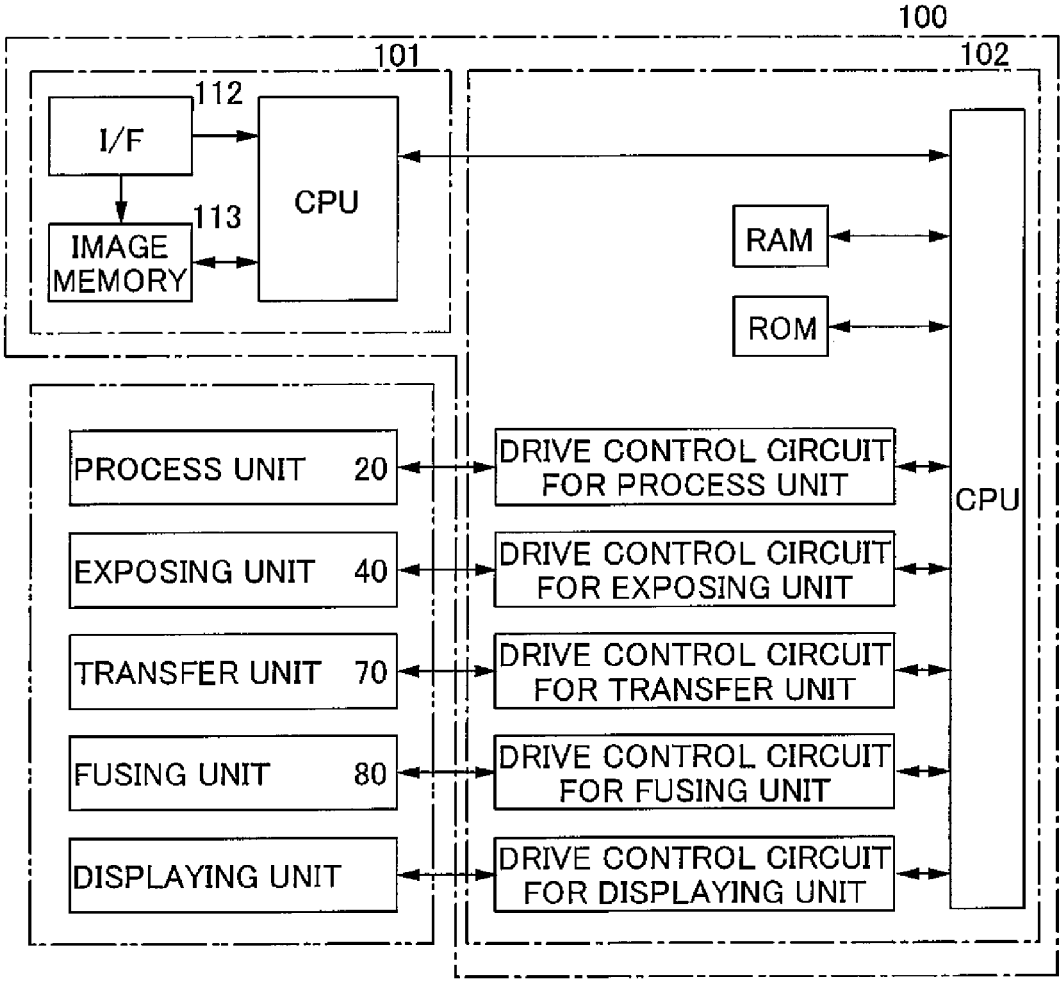
FIG. 2 is a block diagram showing the configuration of a control unit 100 of the printer 10.

Next, with reference to FIGS. 1 and 2, examples of configurations and operations of an image forming apparatus are described using a laser beam printer (hereinafter referred to as a printer) 10 as an example. FIG. 1 is a diagram showing main components structuring a printer 10. FIG. 2 is a block diagram showing the configuration of a control unit 100 of the printer 10. Note that, in FIG. 1, the arrow indicates the up-and-down direction; for example, a paper-supply cassette 92 is provided in a lower section of the printer 10 and an exposing unit 40 is provided in an upper section of the printer 10.

Configuration Example of Printer 10

As shown in FIG. 1, the printer 10 according to the present embodiment includes a process unit 20 that serves as an example of the image-forming unit, the exposing unit 40, a toner cartridge 60 that serves as an example of the developer cartridge, a transfer unit 70, a fusing unit 80, a displaying unit (not shown) that serves as means for making notifications to users, and the control unit 100 that controls these units, etc. and that manages operations as a printer (FIG. 2). As shown in FIG. 1, the process unit 20 includes a unit frame 21 that is made of resin and is a framework of the unit, a cartridge-inserted section 22 into which the toner cartridge 60 can be inserted, and a photoconductor 31 that serves as an example of the image-bearing body, and further includes a charging device 32, a developing section 50, and a roller 39, in a rotating direction of the photoconductor 31.

The photoconductor 31 has a photoconductive layer formed on an outer peripheral surface thereof, and bears a latent image on a surface of the photoconductive layer. The photoconductor 31 is rotatable about a central axis, and rotates counterclockwise in this embodiment, as indicated by the arrow in FIG. 1.

The charging device 32 is for charging the photoconductor 31. The exposing unit 40 is a device that forms a latent image on the charged photoconductor 31 by radiating laser beams thereon. The exposing unit 40 has a semiconductor laser, a polygon mirror, an F-θ lens, etc., and radiates modulated laser beams onto the charged photoconductor 31 according to image signals inputted by a not-shown computer such as a personal computer and a word processor.

The developing section 50 has a function of developing a latent image on the photoconductor 31 using toner that serves as an example of developer; the developing section 50 includes a toner containing section 51 that serves as an example of the containing section, a developing roller 52 that serves as an example of the developer-bearing body, a supplying roller 53, a restriction blade 54, and an agitator 56.

The toner containing section 51 is for containing toner. The developing roller 52 rotates bearing toner on the surface thereof so as to carry the toner to a developing position that is opposite the photoconductor 31. The developing roller 52 contacts the photoconductor 31, and makes a latent image borne on the photoconductor 31 visible as a toner image using toner that has been carried to the developing position (in other words, develops the latent image while contacting the photoconductor 31). The supplying roller 53 is a rotatable member that abuts against the developing roller 52; the supplying roller 53 has a function of supplying the developing roller 52 with toner contained in the toner containing section 51, and a function of stripping off from the developing roller 52 toner that remains on the developing roller 52 after development. The restriction blade 54 restricts a layer thickness of toner borne on the developing roller 52 by abutting against the developing roller 52 along an axial direction of the roller; in addition, the restriction blade 54 charges electrically toner borne on the developing roller 52. The agitator 56 has a function of stirring toner by rotation of the agitator, and a function of carrying toner contained in the toner containing section 51 to the supplying roller 53.

The toner cartridge 60 is filled with toner and is attached to the process unit 20 after the cartridge 60 is inserted into the cartridge-inserted section 22. While being attached to the unit frame 21, the toner cartridge 60 supplies the toner containing section 51 with the toner that fills the toner cartridge 60. The configuration of the toner cartridge 60 will be described later.

The transfer unit 70 is a device for transferring onto a medium a toner image that is formed on the photoconductor 31. The roller 39 is for distributing evenly on a surface of the photoconductor 31 toner (the toner image) that has not been transferred onto the medium, by abutting against the photoconductor 31.

The fusing unit 80 includes a fixing roller 80*a* and a pressurizing roller 80*b*, and is a device that heats and pressurizes the toner image transferred on the medium and that makes the image fuse with the medium so as to form a permanent image.

The control unit 100 consists of a main controller 101 and a unit controller 102, as shown in FIG. 2; image signals and control signals are inputted into the main controller 101, and according to instructions based on these image signals and control signals, the unit controller 102 controls each unit, etc. so as to form an image. In addition, the main controller 101 is connected to the computer via an interface 112, and has an image memory 113 for storing image signals inputted by this computer.

Example of Operation of Printer 10

Next, operations of the printer 10 having the above-mentioned configuration are described. First, when image signals and control signals from a not-shown computer are inputted into the main controller 101 of the printer 10 via the interface (I/F) 112, the photoconductor 31, the developing roller 52 and the like rotate under control of the unit controller 102 according to the instructions by the main controller 101.

While rotating, the photoconductor 31 is successively charged by the charging device 32 at a charging position. With rotation of the photoconductor 31, the charged area of the photoconductor 31 reaches an exposing position, and the exposing unit 40 forms a latent image on the area according to image information. The latent image formed on the photoconductor 31 reaches the developing position with rotation of the photoconductor 31, and is developed by the developing roller 52 using toner. Thus, a toner image is formed on the photoconductor 31.

The toner image formed on the photoconductor 31 reaches a transferring position with rotation of the photoconductor 31, and is transferred by the transfer unit 70 onto a medium. Note that the medium is transported from the paper-supply cassette 92 to the transfer unit 70 via a paper-supply roller 94.

The toner image transferred onto the medium is heated and pressurized by the fusing unit 80 and is fused to the medium. The medium to which the toner image has been fused is transported to a paper-discharge tray 98 via a pair of transportation rollers 95 and a pair of paper-discharge rollers 96.

On the other hand, toner that has not been transferred onto the medium and remains on the photoconductor 31 is distributed evenly by the roller 39. The evenly-distributed toner is stripped off by the developing roller 52 at the developing position, and is collected in the toner containing section 51.

Configuration Example of Toner Cartridge 60 and Periphery thereof

Next, with reference to FIGS. 3 through 11, this section describes a configuration example of the toner cartridge 60 and a configuration example of members of the process unit 20, the members being placed in the vicinity of the toner cartridge 60 when the toner cartridge 60 is attached to the process unit 20.

Figure 3:
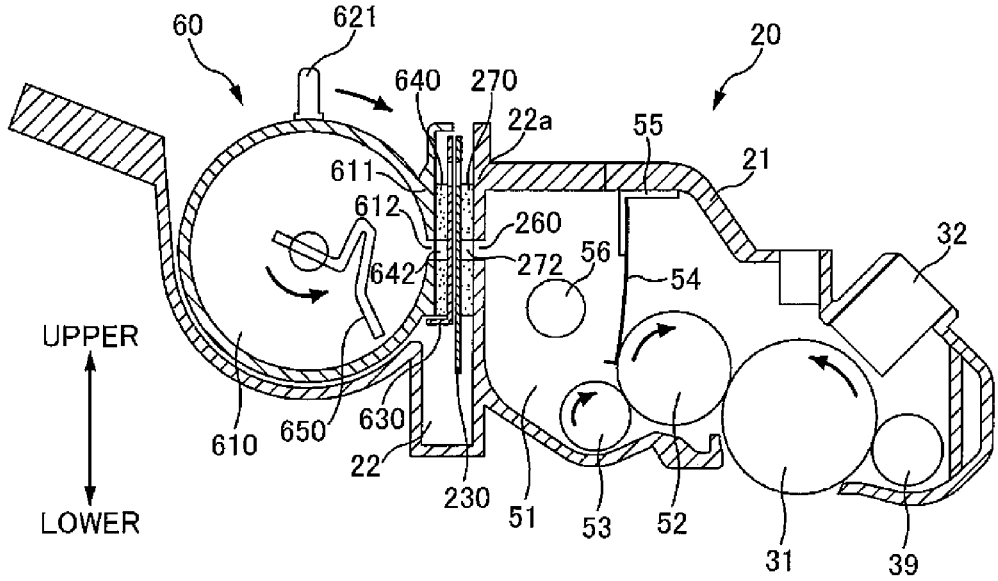
FIG. 3 is a diagram showing a state in which a toner cartridge 60 is inserted into a cartridge-inserted section 22.
Figure 4:
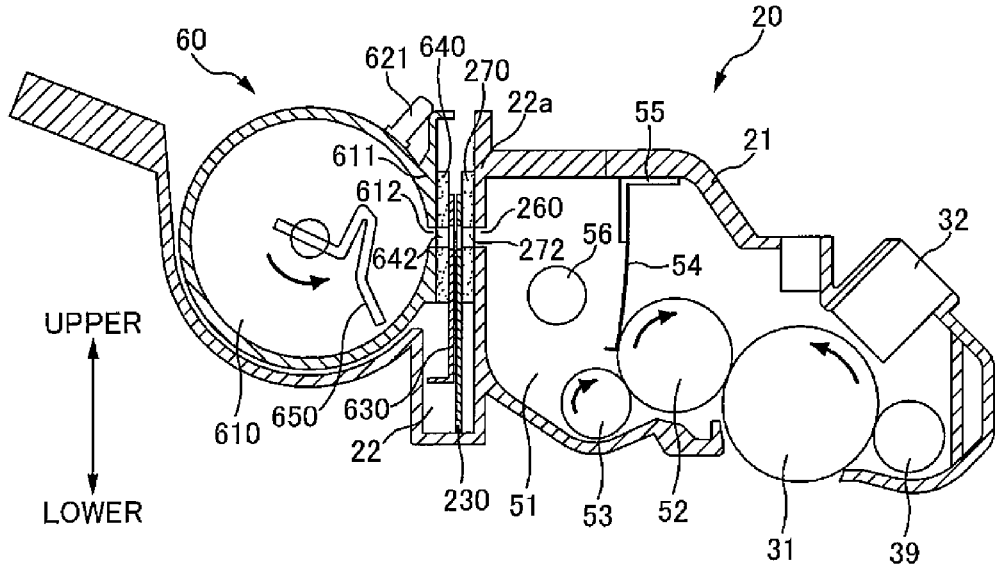
FIG. 4 is a diagram showing a state in which the toner cartridge 60 is attached to a process unit 20.
Figure 5:
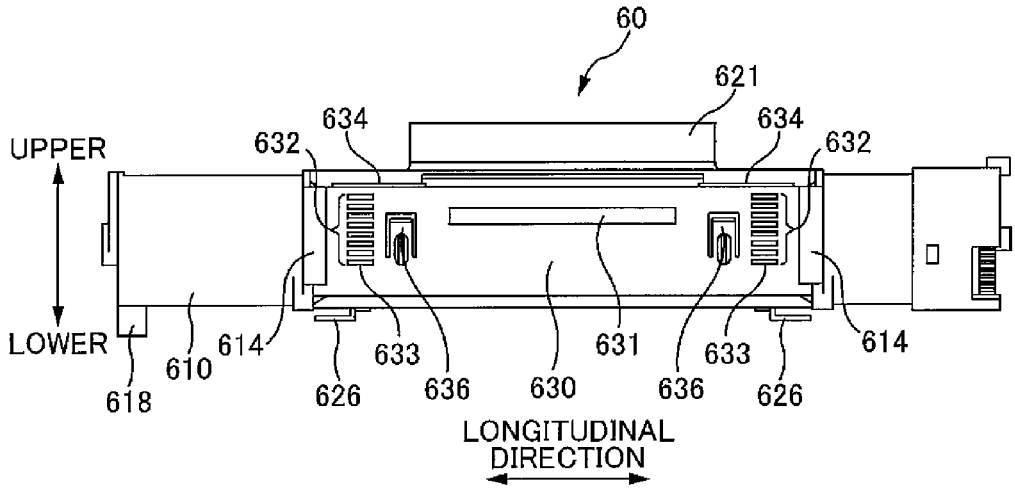
FIG. 5 is a front view of the toner cartridge 60 under a situation in which a CRG shutter 630 is located at a closing position.
Figure 6:
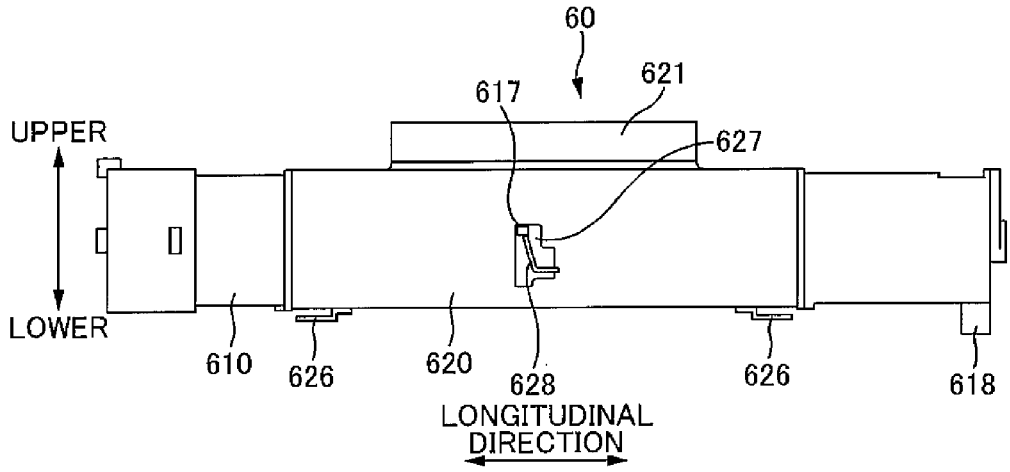
FIG. 6 is a rear view of the toner cartridge 60 shown in FIG. 5.
Figure 7:
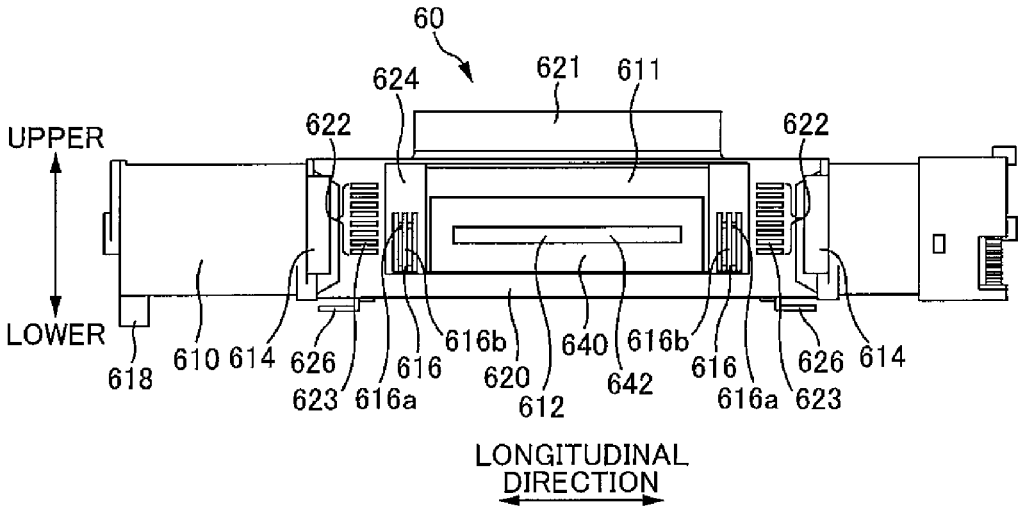
FIG. 7 is a diagram showing a state in which the CRG shutter 630 is removed from the toner cartridge 60 shown in FIG. 5.
Figure 8:
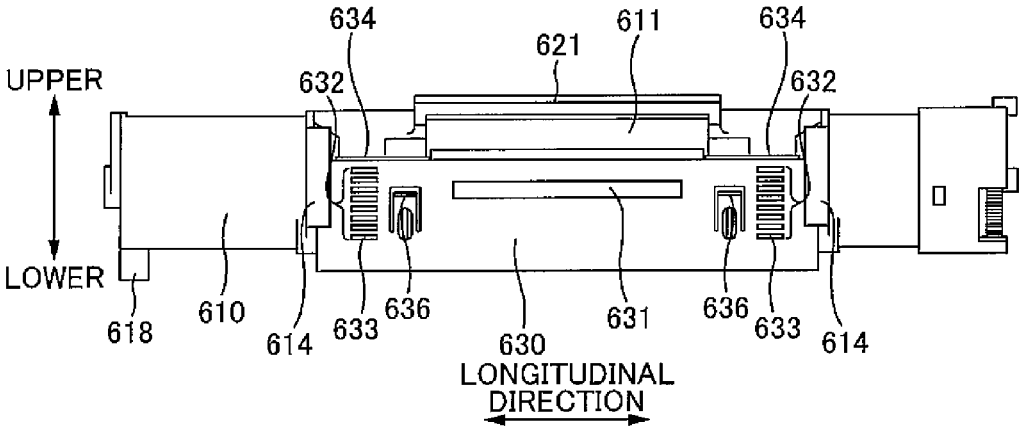
FIG. 8 is a front view of the toner cartridge 60 under a situation in which the CRG shutter 630 is located at an opening position.
Figure 9:
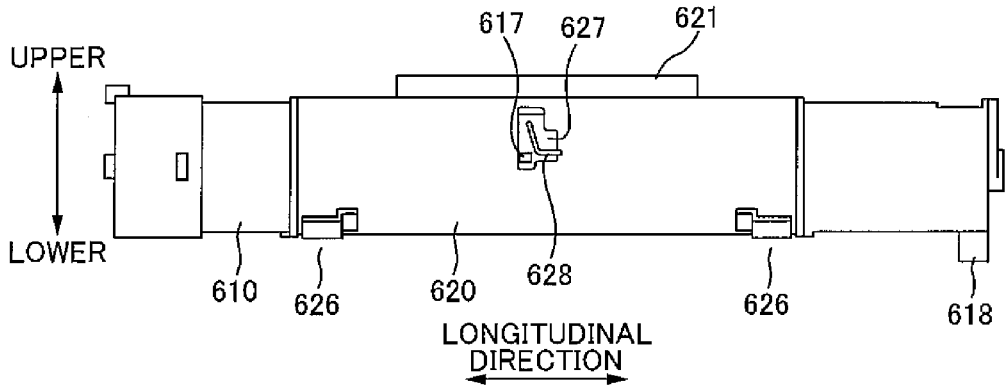
FIG. 9 is a rear view of the toner cartridge 60 shown in FIG. 8.
Figure 10:
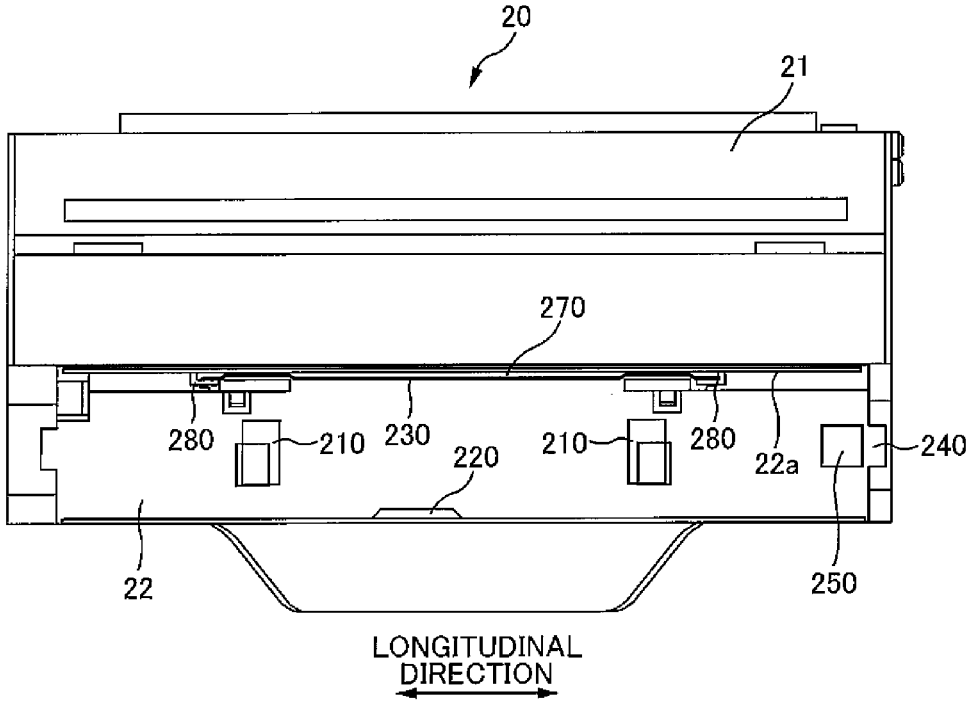
FIG. 10 is a top view of the process unit 20 under a situation in which the toner cartridge 60 is not inserted into the cartridge-inserted section 22.
Figure 11:
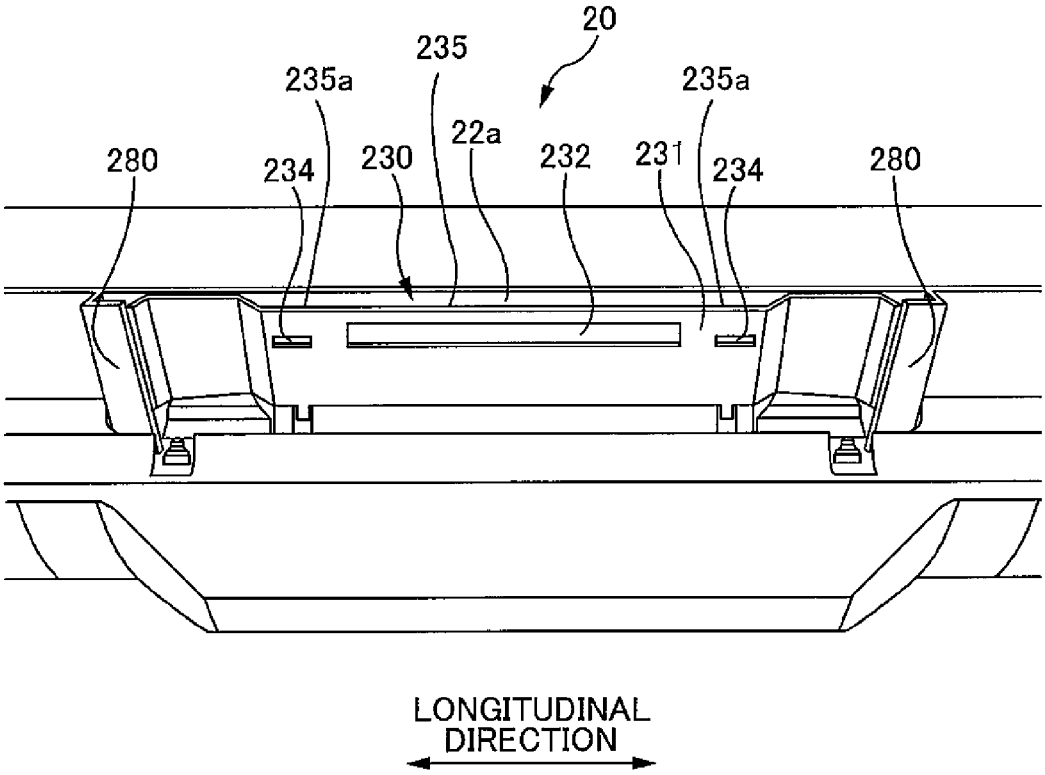
FIG. 11 is a diagram showing an inserted-section shutter 230 and its periphery.

FIG. 3 is a diagram showing a state in which the toner cartridge 60 is inserted into the cartridge-inserted section 22. FIG. 4 is a diagram showing a state in which the toner cartridge 60 is attached to the process unit 20. FIG. 5 is a front view of the toner cartridge 60 under a situation in which a CRG shutter 630 is located at a closing position. FIG. 6 is a rear view of the toner cartridge 60 shown in FIG. 5. FIG. 7 is a diagram showing a state in which the CRG shutter 630 is removed from the toner cartridge 60 shown in FIG. 5. FIG. 8 is a front view of the toner cartridge 60 under a situation in which the CRG shutter 630 is located at an opening position. FIG. 9 is a rear view of the toner cartridge 60 shown in FIG. 8. FIG. 10 is a top view of the process unit 20 under a situation in which the toner cartridge 60 is not inserted into the cartridge-inserted section 22. FIG. 11 is a diagram showing an inserted-section shutter 230 and its periphery. Note that, in FIGS. 3 through 9, the up-and-down direction is indicated by the arrow, and in FIGS. 5 through 11, the longitudinal direction is indicated by the arrow.

Configuration of Toner Cartridge 60

First, the configuration of the toner cartridge 60 is described.

The toner cartridge 60 includes a cartridge body (hereinafter referred to as a "CRG body") 610, an external cover 620 that serves as an example of the handle member, the CRG shutter 630 that serves as an example of the shutter (the second shutter), a cartridge seal (hereinafter referred to as a "CRG seal") 640 that serves as an example of the sealing member, and an agitator 650.

The CRG body 610 is a container containing toner. The CRG body 610 is a cylindrical container whose cross-sectional shape is circular, as shown in FIG. 3. The CRG body 610 has, on an outer peripheral surface thereof, a wall section 611 which is a flat wall, as shown in FIG. 7. The wall section 611 is located on a central section in a longitudinal direction of the CRG body 610.

In addition, the wall section 611 is furnished with a CRG opening 612 through which toner inside the CRG body 610 can pass towards the outside of the CRG body 610. When the CRG opening 612 is exposed, toner inside the CRG body 610 can pass through the CRG opening 612 to move outside the toner cartridge 60. The CRG body 610 includes a guiding section 614 serving as a guide that linearly moves the CRG shutter 630 when the CRG shutter 630 is moving.

Besides, the CRG body 610 has ribs 616 on the outer sides, with respect to the longitudinal direction, of the wall section 611, the ribs 616 serving as an example of the protrusion that can contact the CRG shutter 630 (FIG. 7). The rib 616 is provided such that its longitudinal direction is approximately perpendicular to the longitudinal direction of the CRG body 610. In addition, the rib 616 includes a curved section **616*a* that is located on a side close to one end of the rib in the longitudinal direction of the rib, and that does not contact the CRG shutter 630 when the CRG shutter 630 is moving (see FIG. 16A); the rib 616 also includes a flat section 616*b* that is located on a side close to the other end in the longitudinal direction, and that contacts the CRG shutter 630 when the CRG shutter 630 is moving (see FIG. 16**A).

Further, the CRG body 610 has a protrusion 617 on a rear surface of the body 610 on the central section in the longitudinal direction of the body 610, as shown in FIG. 6. Besides, the CRG body 610 has, on its lower section, a CRG connector 618 that can contact a connector (not shown) provided on the printer body when the toner cartridge 60 is inserted into the cartridge-inserted section 22.

The external cover 620 is a hollow cylinder, and covers the outer peripheral surface of the CRG body 610. The external cover 620 is supported so that it can rotationally move relative to the CRG body 610. The external cover 620 has a handle 621 on a circumferential surface of the cover on a central section in a longitudinal direction of the cover 620; when the handle 621 is operated by a user, etc., the external cover 620 rotationally moves.

The external cover 620 has pinion sections 622 on both ends in the longitudinal direction, the pinion sections 622 consisting of a plurality of projections 623 that are provided at regular intervals, as shown in FIG. 7. Besides, the external cover 620 has, on its lower section, a hook 626 that moves with rotational movement of the external cover 620.

As shown in FIGS. 6 and 9, the external cover 620 has an escape hole 627 such that the protrusion 617 of the CRG body 610 can move relative to the external cover 620 when the handle 621 is operated and the external cover 620 rotationally moves. The external cover 620 includes a lever 628 whose one end connects to an edge of the escape hole 627 and whose other end extends towards the protrusion 617. The above-mentioned protrusion 617 has a function as a fastening section that can fasten the lever 628. Note that the lever 628 is an example of the protruding section.

The CRG seal 640 is fixed to the wall section 611 surrounding the CRG opening 612 as shown in FIG. 7, and is for preventing toner from spilling from between the CRG body 610 and the CRG shutter 630. The CRG seal 640 has, on its central section, a CRG seal opening 642 that serves as an example of the second opening (the opening of the sealing member); a size of the CRG seal opening 642 is approximately the same as a size of the CRG opening 612. Besides, the CRG seal 640 is elastic sponge or urethane foam, and is compressed being sandwiched between the CRG body 610 and the CRG shutter 630.

The CRG shutter 630 is supported so that it can linearly move relative to the CRG body 610, and opens and closes by its linear movement between the opening position (FIG. 8) and the closing position (FIG. 5). The CRG shutter 630 covers the CRG seal opening 642 when being located at the closing position, which is the first position; the CRG shutter 630 exposes the CRG seal opening 642 when being located at the opening position, which is the second position.

The CRG shutter 630 is a thin metal plate whose thickness is less than a thickness of the CRG seal 640, and moves linearly with both ends of the CRG shutter 630 in its longitudinal direction contacting the guiding section 614.

The CRG shutter 630 includes a CRG shutter opening 631 that serves as an example of the opening of the shutter, and that is located on a central section in the longitudinal direction of the CRG shutter 630 and near one end in a transverse direction of the CRG shutter 630, as shown in FIG. 5. When the shutter 630 is located at the opening position, the CRG shutter opening 631 is located opposite the CRG seal opening 642, as shown in FIG. 4; when the shutter 630 is located at the closing position, the CRG shutter opening 631 is not located opposite the CRG seal opening 642, as shown in FIG. 3. Note that a size of the CRG shutter opening 631 is larger than the size of the CRG seal opening 642.

Besides, the CRG shutter 630 has a rack section 632 consisting of a plurality of holes 633 that are provided at regular intervals, as shown in FIG. 5. The projections 623 of the pinion section 622 can engage with the holes 633 of the rack section 632.

Further, as shown in FIG. 5, the CRG shutter 630 includes a CRG contacting section 634 serving as an example of the contacting section that can contact the inserted-section shutter 230 (to be described below) when the CRG shutter 630 moves from the closing position to the opening position. The CRG contacting section 634 is an extending section that extends towards the inserted-section shutter 230 at one end in the transverse direction of the CRG shutter 630.

Further, the CRG shutter 630 includes engaging pieces 636 (FIG. 5) that engage with the inserted-section shutter 230 only during a certain period in midstream of the closing movement of the CRG shutter 630, i.e., the movement of the CRG shutter 630 from the opening position to the closing position. The engaging piece 636 is elastic; by deforming elastically, each engaging piece 636 engages with the inserted-section shutter 230 and disengages from the inserted-section shutter 230. Furthermore, the engaging pieces 636 are located opposite the ribs 616 and near both ends in the longitudinal direction of the CRG shutter 630.

The agitator 650 is provided inside the CRG body 610 as shown in FIG. 3, and is rotatable about a central axis. Rotation of the agitator 650 realizes a function of carrying toner inside the CRG body 610 towards the CRG opening 612, and a function of stirring toner in the CRG body 610. Note that the agitator 650 rotates counterclockwise as indicated by the arrow in FIG. 3, and that its central axis is positioned substantially at the same position as the CRG opening 612 with respect to the up-and-down direction.

Configuration of Cartridge-Inserted Section 22

As mentioned above, the process unit 20 has the cartridge-inserted section 22 into which the toner cartridge 60 is inserted.

As shown in FIGS. 10 and 11, the cartridge-inserted section 22 includes locking holes 210 that serve as an example of the hole section, an unlocking projection portion 220 that serves as an example of the unlocking section, the inserted-section shutter 230 that serves as an example of the shutter (the first shutter), a recess 240, a through hole 250, an inserted-section opening 260 (FIG. 3), and an inserted-section seal 270 that serves as an example of the sealing member. Note that the inserted-section shutter 230 and the inserted-section seal 270 constitute the first shutter device, and that the CRG shutter 630 and the CRG seal 640 mentioned above constitute the second shutter device.

The locking hole 210 is a hole through which the hook 626 of the external cover 620 can move when the toner cartridge 60 is inserted into the cartridge-inserted section 22, and through which the hook 626 cannot move when the toner cartridge 60 is attached to the printer.

The unlocking projection portion 220 is for releasing the external cover 620 that is locked in the CRG body 610 from the CRG body 610; the unlocking projection portion 220 deforms the lever 628 of the external cover 620 by contacting the lever 628 so that the lever 628 fastened by the protrusion 617 is released from the protrusion 617.

The recess 240 serves as a guide when the toner cartridge 60 is inserted into the cartridge-inserted section 22. That is, the CRG connector 618 enters along the recess 240 so that the toner cartridge 60 is inserted into the cartridge-inserted section 22.

The through hole 250 is a hole through which the CRG connector 618 of the toner cartridge 60 can pass. The CRG connector 618 that passes through the through hole 250 contacts a connector provided on the printer body when the toner cartridge 60 is inserted into the cartridge-inserted section 22.

The inserted-section opening 260 is provided in a partitioning wall 22*a* that separates the toner containing section 51 and the cartridge-inserted section 22, as shown in FIGS. 3 and 4; when the inserted-section opening 260 is exposed, toner inside the toner cartridge 60 is supplied to the toner containing section 51.

The inserted-section seal 270 is fixed to the partitioning wall 22*a* surrounding the inserted-section opening 260, and is for preventing toner from spilling from between the partitioning wall 22*a* and the inserted-section shutter 230. As shown in FIG. 3, the inserted-section seal 270 has, on its central section, an inserted-section seal opening 272 that serves as an example of the first opening (the opening of a sealing member). A size of the inserted-section seal opening 272 is the same as a size of the inserted-section opening 260. Besides, in a similar way as the CRG seal 640, the inserted-section seal 270 is made of elastic sponge or urethane foam, and is compressed between the partitioning wall 22*a* and the inserted-section shutter 230.

The inserted-section shutter 230 is supported by the partitioning wall 22*a* so that it can linearly move, and opens and closes by linear movement between a closing position (FIG. 3) serving as the first position (the first closing position) and an opening position (FIG. 4) serving as the second position (the first opening position). The inserted-section shutter 230 covers the inserted-section seal 270 when being located at the closing position, and exposes the inserted-section seal 270 when being located at the opening position. Note that the above-mentioned opening position of the CRG shutter 630 is the second opening position, and that the closing position of the CRG shutter 630 is the second closing position.

The inserted-section shutter 230 is a thin metal plate whose thickness is less than the thickness of the inserted-section seal 270, and moves linearly with both ends of the inserted-section shutter 230 in its longitudinal direction contacting the guiding sections 280 that are provided on the partitioning wall 22*a* (the longitudinal direction of the shutter 230 is along the longitudinal direction of the CRG shutter 630).

Besides, the inserted-section shutter 230 includes a projecting section 231 on a central section in the longitudinal direction of the shutter 230, and the projecting section 231 projects to a distal direction from the partitioning wall 22*a* (projects towards the CRG shutter 630 when the toner cartridge 60 is inserted into the cartridge-inserted section 22), as shown in FIG. 11. The inserted-section seal 270 is compressed between the projecting section 231 and the partitioning wall 22*a*.

The projecting section 231 includes an inserted-section shutter opening 232 that serves as an example of the opening of the shutter. When the inserted-section shutter 230 is located at the opening position, the shutter 230 is located at a position at which the inserted-section shutter opening 232 is opposite the inserted-section seal opening 272, as shown in FIG. 4; when the shutter 230 is located at the closing position, the shutter 230 is located at a position at which the inserted-section shutter opening 232 is not opposite the inserted-section seal opening 272, as shown in FIG. 3. A size of the inserted-section shutter opening 232 is larger than the size of the inserted-section seal opening 272.

Besides, the projecting section 231 has engaged holes 234 on the outer sides, with respect to the longitudinal direction, of the inserted-section shutter opening 232 (i.e., on both end sides in the longitudinal direction); the engaged hole 234 serves as an example of the engaged-hole section with which the engaging piece 636 of the CRG shutter 630 can engage.

Operation Examples of Toner Cartridge and its Periphery when Attaching/Detaching Toner Cartridge Next, operation examples of the toner cartridge and its periphery when attaching/detaching the toner cartridge 60 are described with reference to FIGS. 3 through 11, 12A through 12D, 13A, 13B, 14A through 14C, 15A through 15C, 16A through 16C, 17A through 17D, 18A, and 18B.

Figure 12A:
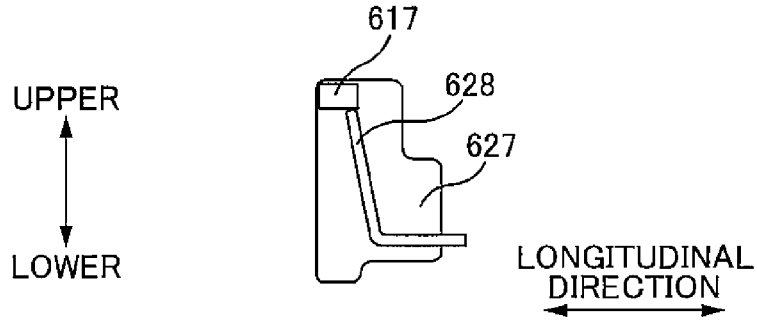
FIG. 12A is a diagram showing a state in which a protrusion 617 fastens a lever 628 when the toner cartridge 60 is not inserted into the cartridge-inserted section 22.
Figure 12B:
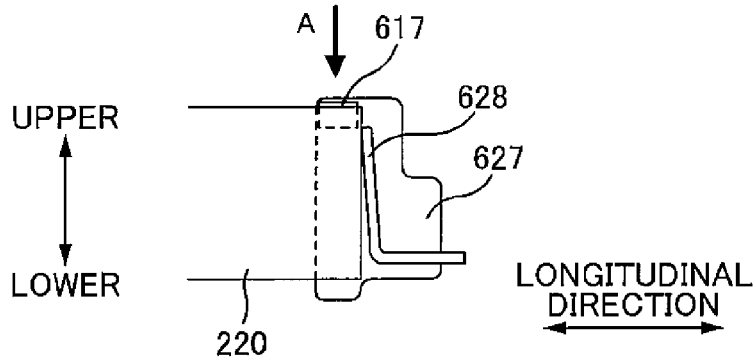
FIG. 12B is a diagram showing a state in which the lever 628 fastened by the protrusion 617 is released from the protrusion 617 when the toner cartridge 60 is inserted into the cartridge-inserted section 22.
Figure 12C:
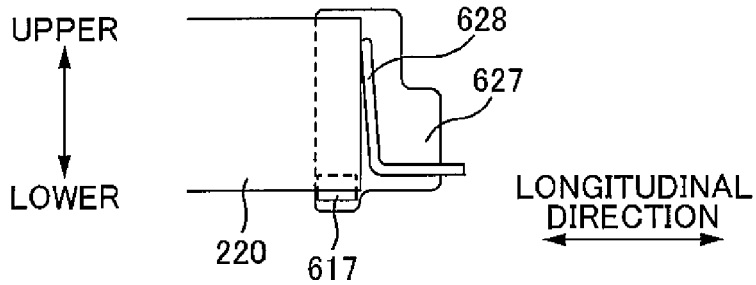
FIG. 12C is a diagram showing a state in which the lever 628 fastened by the protrusion 617 is released from the protrusion 617 when the toner cartridge 60 is attached to the process unit 20.
Figure 12D:
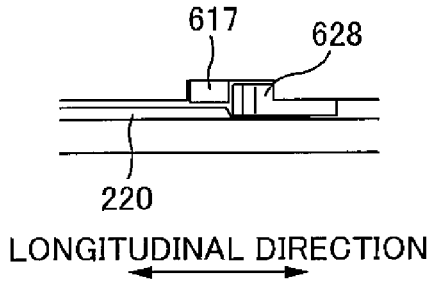
FIG. 12D is a diagram of the protrusion 617, etc. viewed in A direction indicated in FIG. 12B.

FIGS. 12A through 12D are diagrams for describing locking and releasing of the external cover 620 in and from the CRG body 610. FIG. 12A is a diagram showing a state in which the protrusion 617 fastens the lever 628 when the toner cartridge 60 is not inserted into the cartridge-inserted section 22. FIG. 12B is a diagram showing a state in which the lever 628 fastened by the protrusion 617 is released from the protrusion 617 when the toner cartridge 60 is inserted into the cartridge-inserted section 22. FIG. 12C is a diagram showing a state in which the lever 628 fastened by the protrusion 617 is released from the protrusion 617 when the toner cartridge 60 is attached to the process unit 20. FIG. 12D is a diagram of the protrusion 617, etc. viewed in A direction indicated in FIG. 12B.

Figure 13A:
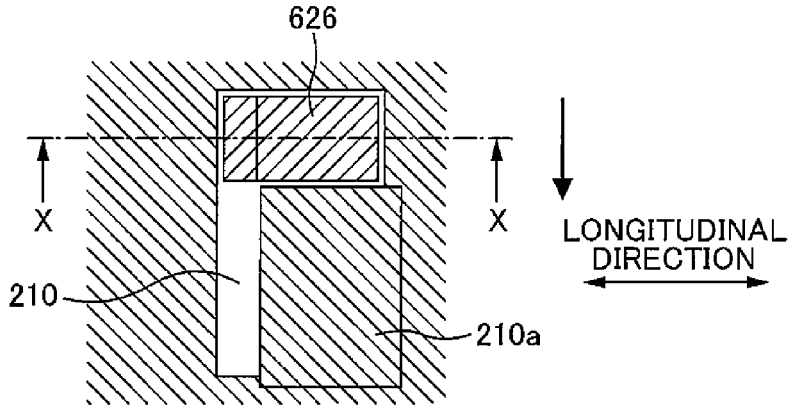
FIG. 13A is a diagram showing a positional relationship between a hook 626 and a locking hole 210 under the situation in which the toner cartridge 60 is inserted into the cartridge-inserted section 22.
Figure 13B:
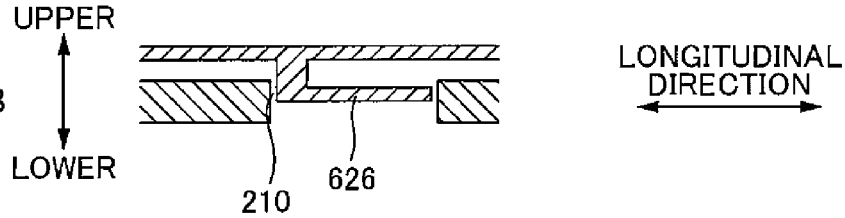
FIG. 13B is a cross-sectional view taken along line X-X of FIG. 13A.
Figure 13C:
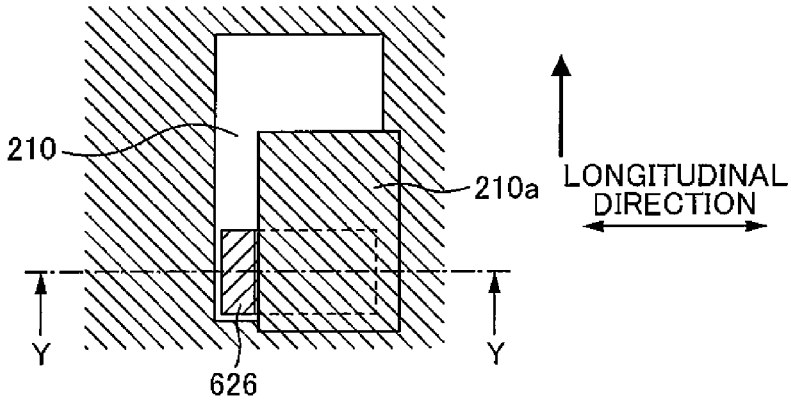
FIG. 13C is a diagram showing a positional relationship between the hook 626 and the locking hole 210 under the situation in which the toner cartridge 60 is attached to the process unit 20.
Figure 13D:
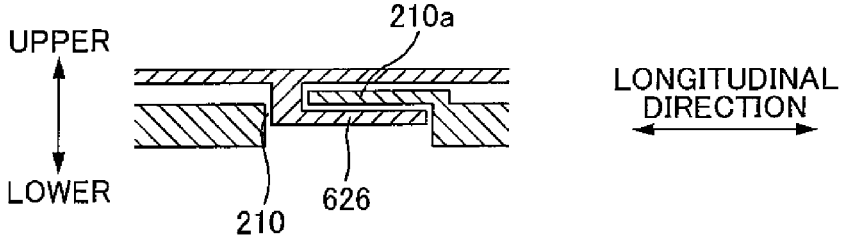
FIG. 13D is a cross-sectional view taken along line Y-Y of FIG. 13C.

FIGS. 13A through 13D are diagrams for describing locking and releasing of the CRG body 610 in and from the cartridge-inserted section 22. FIG. 13A is a diagram showing a positional relationship between the hook 626 and the locking hole 210 under the situation in which the toner cartridge 60 is inserted into the cartridge-inserted section 22. FIG. 133 is a cross-sectional view taken along line X-X of FIG. 13A. FIG. 13C is a diagram showing a positional relationship between the hook 626 and the locking hole 210 under the situation in which the toner cartridge 60 is attached to the process unit 20. FIG. 13D is a cross-sectional view taken along line Y-Y of FIG. 13C.

Figure 14A:
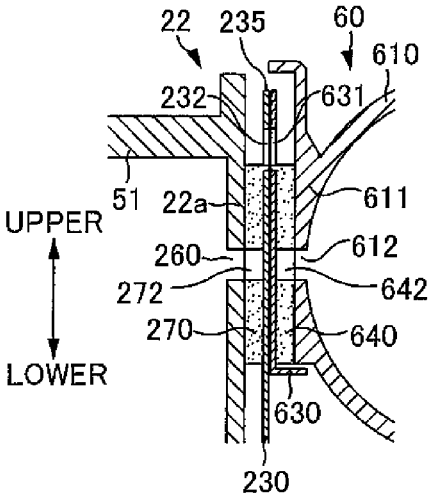
FIG. 14A is a diagram showing a periphery of the CRG shutter 630 and the inserted-section shutter 230 under the situation in which the toner cartridge 60 is inserted into the cartridge-inserted section 22.
Figure 14B:
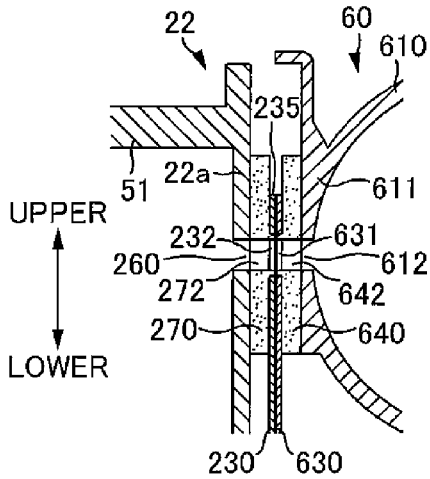
FIG. 14B is a diagram showing the periphery of the CRG shutter 630 and the inserted-section shutter 230 under the situation in which the toner cartridge 60 is attached to the process unit 20.
Figure 14C:
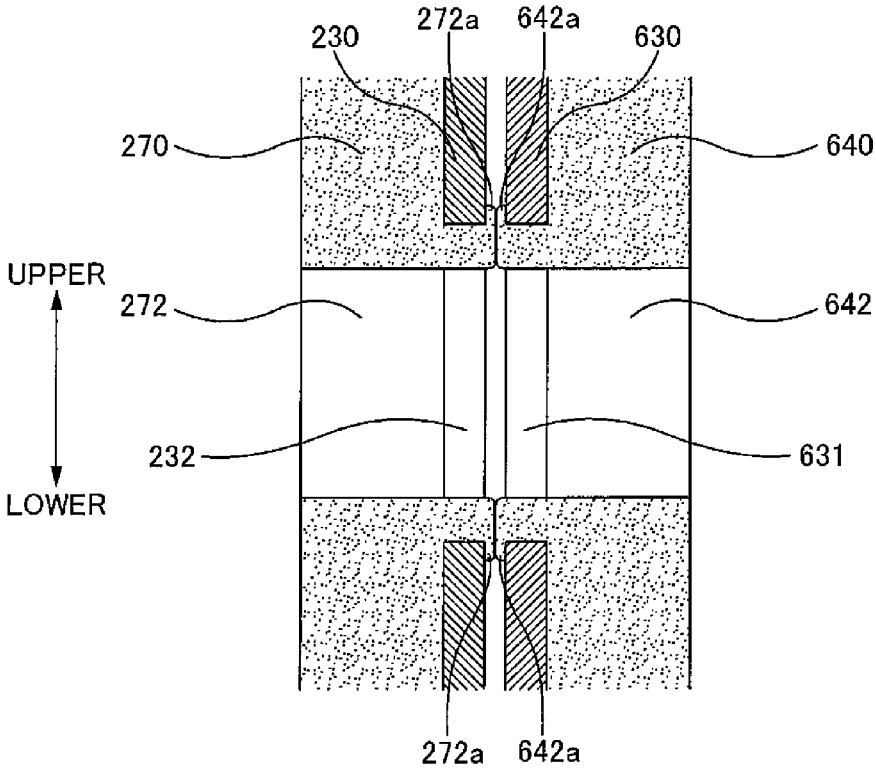
FIG. 14C is a magnified view of important sections of FIG. 14B.

FIG. 14A is a diagram showing a periphery of the CRG shutter 630 and the inserted-section shutter 230 under the situation in which the toner cartridge 60 is inserted into the cartridge-inserted section 22. FIG. 14B is a diagram showing the periphery of the CRG shutter 630 and the inserted-section shutter 230 under the situation in which the toner cartridge 60 is attached to the process unit 20. FIG. 14C is a magnified view of important sections of FIG. 14B.

Figure 15A:
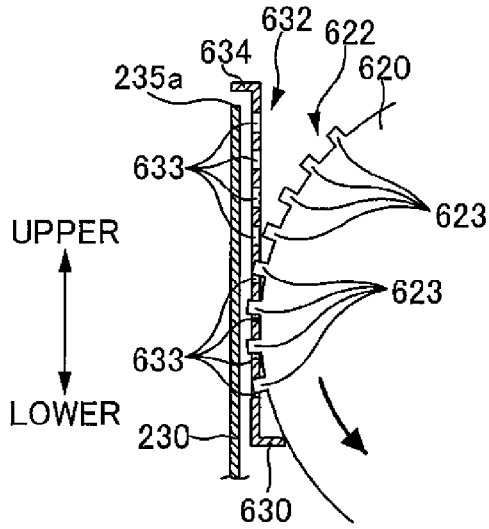
FIG. 15A is a diagram showing a rack section 632 and a pinion section 622 under the situation in which the CRG shutter 630 is located at the closing position.
Figure 15B:
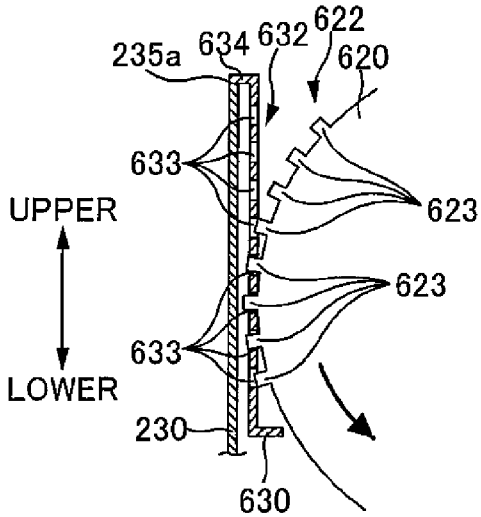
FIG. 15B is a diagram showing the rack section 632 and the pinion section 622 under a situation in which a CRG contacting section 634 of the CRG shutter 630 that is moving contacts the inserted-section shutter 230.
Figure 15C:
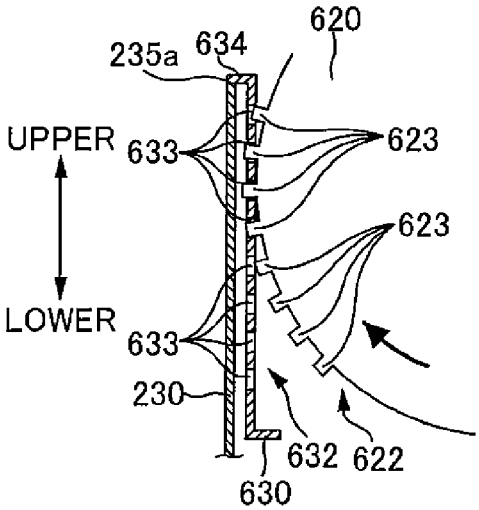
FIG. 15C is a diagram showing the rack section 632 and the pinion section 622 under the situation in which the CRG shutter 630 is located at the opening position.

FIGS. 15A through 15C are diagrams for describing a mechanism by which rotational-movement force that rotationally moves the external cover 620 is converted into linear-movement force that linearly moves the CRG shutter 630. FIG. 15A is a diagram showing the rack section 632 and the pinion section 622 under the situation in which the CRG shutter 630 is located at the closing position. FIG. 15B is a diagram showing the rack section 632 and the pinion section 622 under a situation in which the CRG contacting section 634 of the CRG shutter 630 that is moving contacts the inserted-section shutter 230. FIG. 15C is a diagram showing the rack section 632 and the pinion section 622 under the situation in which the CRG shutter 630 is located at the opening position.

Figure 16A:
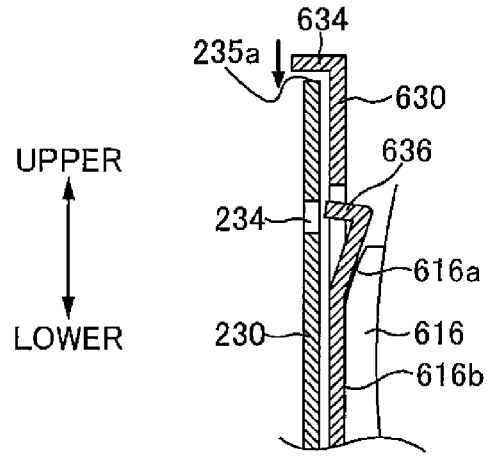
FIG. 16A is a diagram showing a positional relationship between an engaging piece 636 and a rib 616 under the situation in which the CRG shutter 630 is located at the closing position.
Figure 16B:
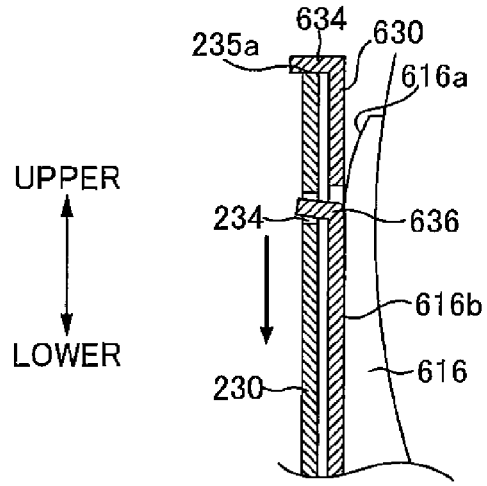
FIG. 16B is a diagram showing a positional relationship between the engaging piece 636 and the rib 616 under the situation in which the CRG contacting section 634 of the CRG shutter 630 that is moving contacts the inserted-section shutter 230.
Figure 16C:
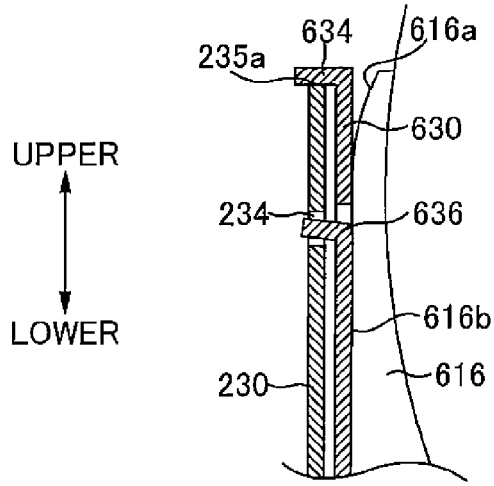
FIG. 16C is a diagram showing a positional relationship between the engaging piece 636 and the rib 616 under the situation in which the CRG shutter 630 is located at the opening position.

FIGS. 16A through 16C are diagrams for describing opening movement of the CRG shutter 630 and the inserted-section shutter 230. FIG. 16A is a diagram showing a positional relationship between the engaging piece 636 and the rib 616 under the situation in which the CRG shutter 630 is located at the closing position. FIG. 16B is a diagram showing a positional relationship between the engaging piece 636 and the rib 616 under the situation in which the CRG contacting section 634 of the CRG shutter 630 that is moving contacts the inserted-section shutter 230. FIG. 16C is a diagram showing a positional relationship between the engaging piece 636 and the rib 616 under the situation in which the CRG shutter 630 is located at the opening position.

Figure 17A:
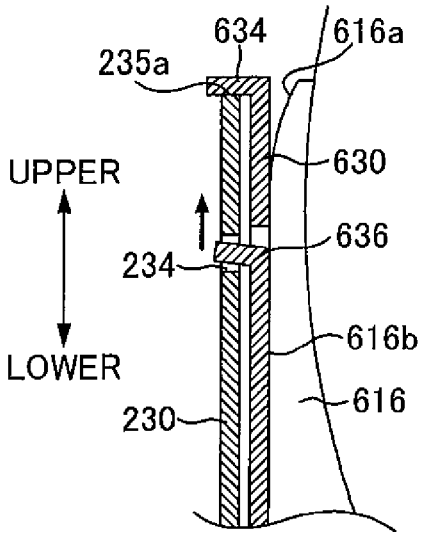
FIG. 17A is a diagram showing a positional relationship between the engaging piece 636 and the rib 616 under the situation in which the CRG shutter 630 is located at the opening position.
Figure 17C:
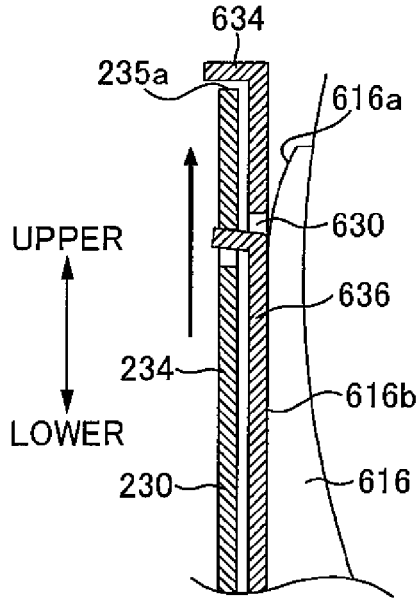
FIG. 17C is a diagram showing a positional relationship between the engaging piece 636 and the rib 616 under a situation in which the inserted-section shutter 230 is operated by the engaging piece 636 and reaches its closing position.
Figure 17B:
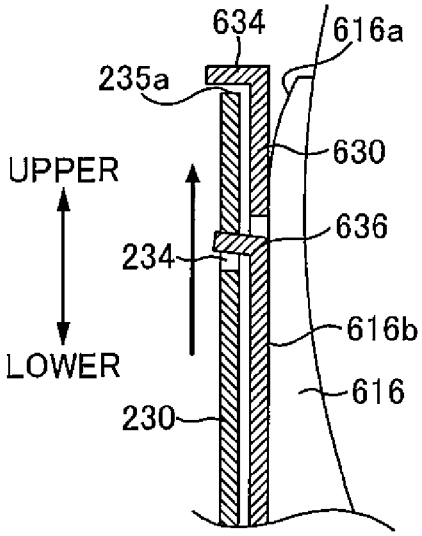
FIG. 17B is a diagram showing a positional relationship between the engaging piece 636 and the rib 616 under a situation in which the engaging piece 636 of the CRG shutter 630 that is moving engages with the inserted-section shutter 230.
Figure 17D:
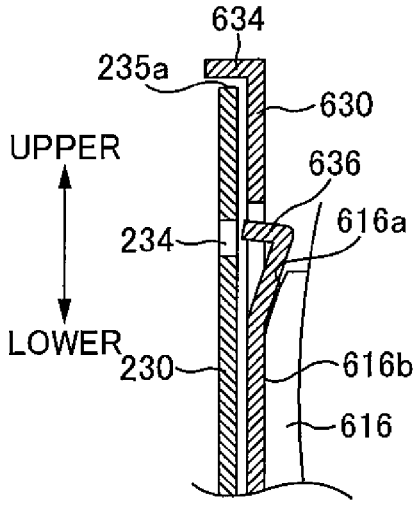
FIG. 17D is a diagram showing a positional relationship between the engaging piece 636 and the rib 616 under the situation in which the CRG shutter 630 is located at the closing position.

FIGS. 17A through 17D are diagrams for describing closing movement of the CRG shutter 630 and the inserted-section shutter 230. FIG. 17A is a diagram showing a positional relationship between the engaging piece 636 and the rib 616 under the situation in which the CRG shutter 630 is located at the opening position. FIG. 17B is a diagram showing a positional relationship between the engaging piece 636 and the rib 616 under a situation in which the engaging piece 636 of the CRG shutter 630 that is moving engages with the inserted-section shutter 230. FIG. 17C is a diagram showing a positional relationship between the engaging piece 636 and the rib 616 under a situation in which the inserted-section shutter 230 is operated by the engaging piece 636 and reaches the closing position. FIG. 17D is a diagram showing a positional relationship between the engaging piece 636 and the rib 616 under the situation in which the CRG shutter 630 is located at the closing position.

Figure 18A:
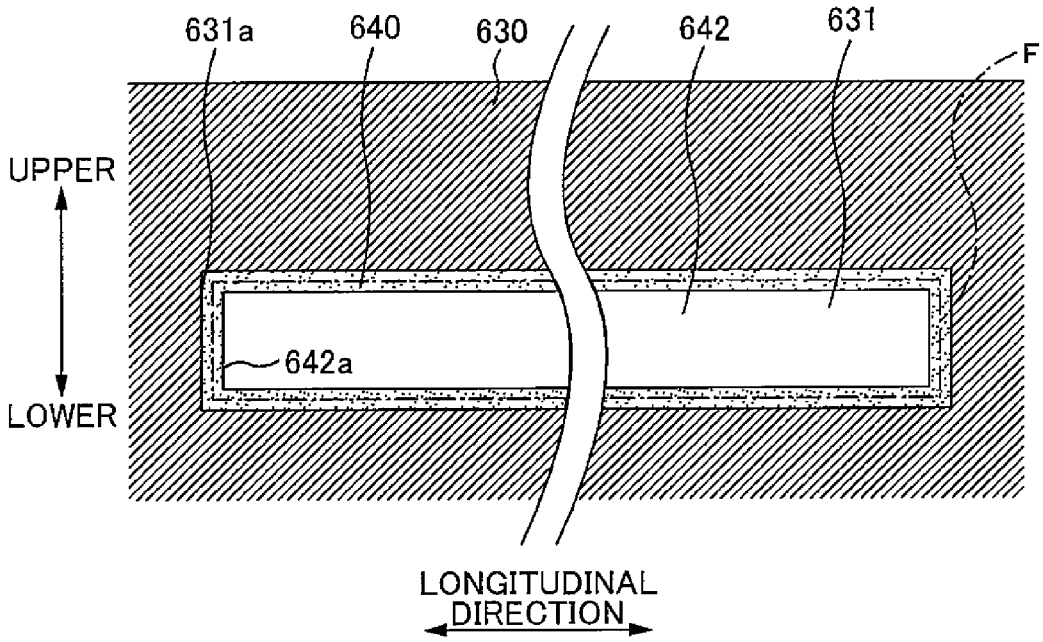
FIG. 18A is a diagram showing a positional relationship between the CRG shutter 630 and a CRG seal 640 under the situation in which the CRG shutter 630 is located at the opening position.
Figure 18B:
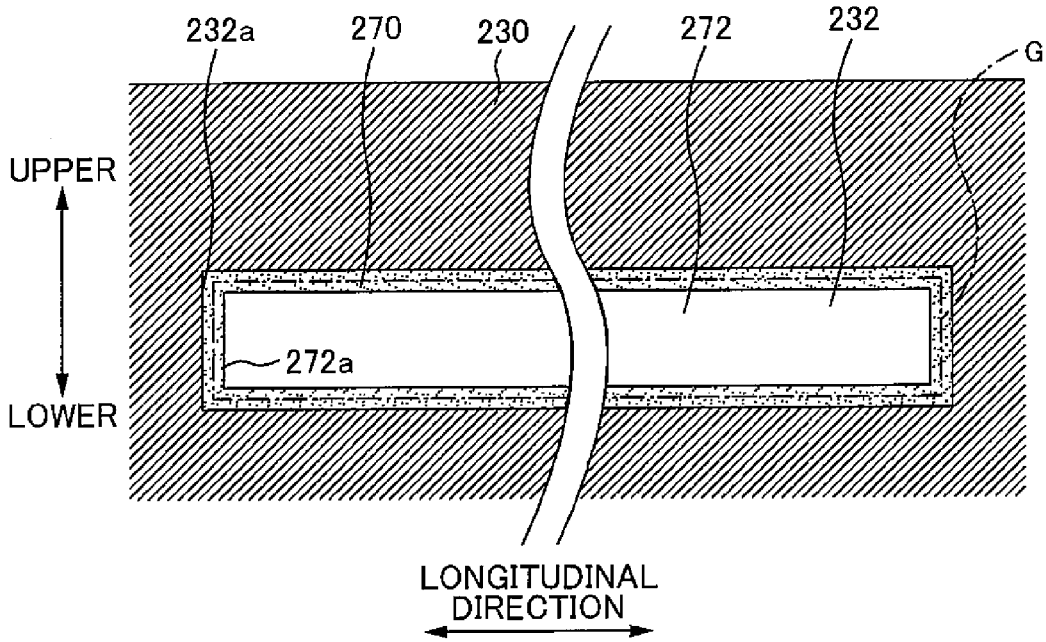
FIG. 18B is a diagram showing a positional relationship between the inserted-section shutter 230 and an inserted-section seal 270 under a situation in which the inserted-section shutter 230 is located at its opening position.

FIG. 18A is a diagram showing a positional relationship between the CRG shutter 630 and the CRG seal 640 under the situation in which the CRG shutter 630 is located at the opening position. FIG. 18B is a diagram showing a positional relationship between the inserted-section shutter 230 and the inserted-section seal 270 under a situation in which the inserted-section shutter 230 is located at the opening position.

Note that, in FIGS. 13A and 13C, components of the toner cartridge 60 except the hook 626 are not shown, for convenience of explanation. Further, in FIGS. 12A through 12C, 13B, 13D, 14A, 14B, 15A through 15C, 16A through 16C, 17A through 17D, 18A, and 18B, the up-and-down direction is indicated by their respective arrows, and in FIGS. 12A through 12D, 13A through 13D, 18A, and 18B, the longitudinal direction is indicated by their respective arrows.

Operation Examples of Toner Cartridge and Peripheral Members when Attaching Toner Cartridge First, operation examples of the toner cartridge 60 and its peripheral members when attaching the toner cartridge 60 to the process unit 20 are described.

1. Regarding Initial State

This section describes an initial state of the toner cartridge 60 and its peripheral members, that is, a state of the toner cartridge 60 and its peripheral members before the toner cartridge 60 is inserted into the cartridge-inserted section 22 of the process unit 20.

As shown in FIG. 5, when the toner cartridge 60 is not inserted into the cartridge-inserted section 22, the CRG shutter 630 is resting at the closing position and the CRG seal opening 642 of the CRG seal 640 (as well as the CRG opening 612) is covered.

Besides, as shown in FIG. 6, when the toner cartridge 60 is not inserted into the cartridge-inserted section 22, the lever 628 of the external cover 620 contacts the protrusion 617 of the CRG body 610 and is fastened by the protrusion 617. Therefore, when the toner cartridge 60 is not inserted into the cartridge-inserted section 22, rotational movement of the external cover 620 relative to the CRG body 610 is restricted. Accordingly, the protrusion 617 and the lever 628 constitute a handle-member locking section that is for locking the external cover 620 so that the cover 620 cannot rotationally move relative to the CRG body 610.

Further, some of the plurality of projections 623 that constitute the pinion section 622 engage with some of the plurality of holes 633 that constitute the rack section 632 (see FIG. 15A). The engaging piece 636 of the CRG shutter 630 is located opposite the curved section 616*a* of the rib 616 (however, does not contact the curved section 616*a*) and does not contact the flat section 616*b*. Therefore, the engaging piece 636 is not pushed by the flat section 616*b* (see FIG. 16A).

In the side of the cartridge-inserted section 22, as shown in FIG. 11, the inserted-section shutter 230 is resting at the closing position, and the inserted-section seal opening 272 of the inserted-section seal 270 (as well as the inserted-section opening 260) is covered.

2. Regarding Operations until Toner Cartridge 60 is Inserted into Cartridge-Inserted Section 22

This section describes operations of the toner cartridge 60, etc. that are carried out until the toner cartridge 60 is inserted into the cartridge-inserted section 22, that is, until the state shown in FIG. 3.

When a user, etc. grabs the handle 621 and lowers the toner cartridge 60 into the cartridge-inserted section 22, the CRG connector 618 enters along the recess 240 and the toner cartridge 60 is inserted into the cartridge-inserted section 22. When the toner cartridge 60 is inserted into the cartridge-inserted section 22, the CRG shutter 630 and the inserted-section shutter 230 are located adjacent to each other and oppose, as shown in FIG. 14A.

Besides, when the toner cartridge 60 is inserted into the cartridge-inserted section 22, the unlocking projection portion 220 releases the external cover 620 that is locked in the CRG body 610 from the CRG body 610. That is, when the toner cartridge 60 is not inserted into the cartridge-inserted section 22, the lever 628 is fastened by the protrusion 617, as shown in FIG. 12A; when the toner cartridge 60 is inserted into the cartridge-inserted section 22, the fastening of the lever 628 by the protrusion 617 is released as a result that the unlocking projection portion 220 deforms the lever 628 by contacting the lever 628, as shown in FIG. 12B. Therefore, when the toner cartridge 60 is inserted into the cartridge-inserted section 22, the unlocking projection portion 220 releases the locking so that the rotational movement of the external cover 620 is allowed.

Further, on the way in which the toner cartridge 60 is being inserted into the cartridge-inserted section 22, the CRG connector 618 passes through the through hole 250; when the toner cartridge 60 is completely inserted into the cartridge-inserted section 22, the CRG connector 618 contacts a connector provided on the printer body.

Furthermore, on the way in which the toner cartridge 60 is being inserted into the cartridge-inserted section 22, the hook 626 moves through the locking hole 210; when the toner cartridge 60 is completely inserted into the cartridge-inserted section 22, the hook 626 is in a state where it can still move in the locking hole 210, as shown in FIG. 13A.

When the toner cartridge 60 is being inserted into the cartridge-inserted section 22, the CRG shutter 630 is resting at the closing position, and the engaging piece 636 is not pushed by the rib 616 (the flat section 616*b*), as shown in FIG. 16A. Therefore, the engaging piece 636 does not project towards the inserted-section shutter 230 nor engage with the engaged hole 234.

3. Regarding Operations when Handle is Operated

This section describes operations of the toner cartridge 60, etc. that are carried out until the CRG shutter 630 located at the closing position reaches the opening position, that is, until the state shifts from that shown in FIG. 3 to that shown in FIG. 4.

After the lever 628 that has been fastened by the protrusion 617 is released from the protrusion 617 by the unlocking projection portion 220, a user, etc. pushes the handle 621 in a predetermined direction (the direction indicated by the arrow in FIG. 3) (operates the handle 621) so that the external cover 620 starts rotational movement. In rotational movement of the external cover 620, the unlocking projection portion 220 keeps contacting the lever 628 as shown in FIGS. 12B through 12D. Therefore, during rotational movement of the external cover 620, the protrusion 617 does not fasten the lever 628.

In rotational movement of the external cover 620, the CRG shutter 630 moves linearly. In other words, force exerted as a result of the user, etc. pushing the handle 621 is transmitted to the external cover 620 as rotational-movement force that rotationally moves the external cover 620. The external cover 620 moves rotationally with the rack section 632 and the pinion section 622 engaging with each other so that the rotational-movement force is converted into, and is transmitted to the CRG shutter 630 as, linear-movement force that linearly moves the CRG shutter 630, through the pinion section 622 and the rack section 632. Accordingly, the CRG shutter 630 moves linearly by the linear-movement force while contacting the guiding section 614. As mentioned above, the rack section 632 and the pinion section 622 have a function of a conversion mechanism that converts the rotational-movement force into the linear-movement force.

A user, etc. pushes the handle 621 from the position shown in FIG. 3 to the position shown in FIG. 4 (in conjunction with this, the external cover 620 rotationally moves) so that the CRG shutter 630 linearly moves from the closing position to the opening position (i.e., carries out opening movement) as shown in FIGS. 15A through 15C. When the handle 621 is pushed to the position shown in FIG. 4, the toner cartridge 60 gets attached to the cartridge-inserted section 22. When the toner cartridge 60 is completely attached to the cartridge-inserted section 22, the CRG shutter 630 reaches its completely-opened state, as shown in FIG. 14B.

Further, when the CRG shutter 630 linearly moves, the CRG contacting section 634 of the CRG shutter 630 makes the inserted-section shutter 230 moves linearly with the shutter 230 contacting the guiding section 280.

In other words, when the CRG shutter 630 is located at the closing position, the CRG contacting section 634 does not contact the inserted-section shutter 230, as shown in FIG. 16A. However, immediately after the CRG shutter 630 starts moving from the closing position, the CRG contacting section 634 contacts one end 235 of the projecting section 231 of the inserted-section shutter 230 in a transverse direction of the inserted-section shutter 230 (more specifically, a one-end contacting section 235*a* of the one end 235 in the transverse direction of the inserted-section shutter 230), as shown in FIG. 16B. When the CRG shutter 630 moves further, the CRG contacting section 634 contacts and pushes (specifically, pushes down) the one-end contacting section 235*a*. As a result thereof, the inserted-section shutter 230 linearly moves from the closing position to the opening position (i.e., carries out opening movement), as shown in FIG. 16C. Note that the one-end contacting section 235*a* serves as a contacting section that contacts the CRG shutter 630 when the inserted-section shutter 230 moves from the closing position to the opening position.

Further, since the inserted-section shutter 230 linearly moves as a result of being pushed by the CRG contacting section 634, a time when the CRG shutter 630 reaches the opening position is the same as a time when the inserted-section shutter 230 reaches the opening position. When the inserted-section shutter 230 linearly moves from the closing position to the opening position, the engaging piece 636 of the CRG shutter 630 is elastically deformed by being pressed by the flat section 616*b* of the rib 616, but the engaging piece 636 does not engage with (does not contact) the engaged hole 234 of the inserted-section shutter 230, as shown in FIGS. 16B and 16C.

Furthermore, movement of the CRG shutter 630 from the closing position to the opening position makes the CRG seal opening 642 be exposed through the CRG shutter opening 631 that is opposite the CRG seal opening 642, as shown in FIG. 4. In a similar manner, movement of the inserted-section shutter 230 from the closing position to the opening position also makes the inserted-section seal opening 272 be exposed through the inserted-section shutter opening 232 that is opposite the inserted-section seal opening 272.

As shown in FIG. 18A, when the CRG shutter 630 is located at the opening position, the CRG shutter 630 presses the CRG seal 640 in a state where an entire edge section 631*a* around the CRG shutter opening 631 surrounds an entire edge section 642*a* around the CRG seal opening 642. In a similar manner, as shown in FIG. 18B, when the inserted-section shutter 230 is located at the opening position, the inserted-section shutter 230 presses the inserted-section seal 270 in a state where an entire edge section 232*a* around the inserted-section shutter opening 232 surrounds an entire edge section 272*a* around the inserted-section seal opening 272. As shown in FIG. 14B, the CRG seal 640 that is pressed by the CRG shutter 630 and the inserted-section seal 270 that is pressed by the inserted-section shutter 230 contact each other. Further, as shown in FIG. 14C, the edge section 642*a* of the CRG seal 640 and the edge section 272*a* of the inserted-section seal 270 are sandwiched between the CRG shutter 630 and the inserted-section shutter 230.

Further, when a user, etc. presses and moves the handle 621 from the position shown in FIG. 3 to the position shown in FIG. 4 (in conjunction with this, the external cover 620 rotationally moves), the CRG body 610 is locked in the cartridge-inserted section 22.

In other words, when the handle 621 is located at the position shown in FIG. 3 (in other words, the toner cartridge 60 is inserted into the cartridge-inserted section 22), the hook 626 of the external cover 620 can move through the locking hole 210, as shown in FIGS. 13A and 13B. As a result that the handle 621 is pushed, the hook 626 that moves together with movement of the external cover 620 moves to the direction indicated by the arrow in FIG. 13A. When the handle 621 reaches the position shown in FIG. 4 (the position at which the toner cartridge 60 is attached to the cartridge-inserted section 22), the hook 626 reaches the position shown in FIG. 13C. At this stage, since a wall 210*a* works as an obstacle as shown in FIG. 13D, the hook 626 cannot move through the locking hole 210. As mentioned above, the hook 626 and the locking hole 210 constitute a container-locking section for locking the CRG body 610 in the cartridge-inserted section 22.

As mentioned above, the handle 621 is operated and the external cover 620, etc. moves so that the toner cartridge 60 becomes attached to the process unit 20. After the toner cartridge 60 is attached, the agitator 650 inside the CRG body 610 rotates, and thereby, toner inside the CRG body 610 is supplied to the toner containing section 51 via the CRG opening 612 and the inserted-section opening 260.

Operation Examples of Toner Cartridge and its Periphery when Detaching Toner Cartridge Next, operation examples of the toner cartridge 60 and its peripheral members when detaching the toner cartridge 60 from the process unit 20 are described.

1. Regarding Initial State

This section describes an initial state of the toner cartridge 60 and its peripheral members, that is, a state of the toner cartridge 60 and its peripheral members when the toner cartridge 60 is attached to the process unit 20.

When the toner cartridge 60 is attached to the process unit 20, the CRG shutter 630 and the inserted-section shutter 230 are resting at their respective opening positions and opposes each other (adjacent to each other), as shown in FIG. 14B. At this time, toner inside the toner cartridge 60 is able to pass through the CRG seal opening 642 and the inserted-section seal opening 272 that oppose each other, and to move to the toner containing section 51. Besides, as shown in FIG. 15C, some of the plurality of projections 623 that constitute the pinion section 622 of the external cover 620 engage with some of the plurality of holes 633 that constitute the rack section 632 of the CRG shutter 630.

Further, as shown in FIG. 17A, the CRG contacting section 634 of the CRG shutter 630 contacts the inserted-section shutter 230. The engaging piece 636 of the CRG shutter 630 contacts the flat section 616*b* of the rib 616 and is pressed by the flat section 616*b*, but does not engage with (does not contact) the engaged hole 234 of the inserted-section shutter 230.

The CRG seal 640 is compressed between the CRG shutter 630 and the wall section 611, and the CRG seal opening 642 is exposed. In a similar manner, the inserted-section seal 270 is compressed between the inserted-section shutter 230 and the partitioning wall 22*a*, and the inserted-section seal opening 272 is exposed. Further, as shown in FIG. 14B, the CRG seal 640 that is pressed by the CRG shutter 630 and the inserted-section seal 270 that is pressed by the inserted-section shutter 230 contact each other. Furthermore, as shown in FIG. 14C, the edge section 642*a* of the CRG seal 640 and the edge section 272*a* of the inserted-section seal 270 are sandwiched by the CRG shutter 630 and the inserted-section shutter 230.

Since the hook 626 of the external cover 620 is located at the position shown in FIG. 13C and the wall 210*a* works as an obstacle as shown in FIG. 13D, the hook 626 cannot move through the locking hole 210. That is, the CRG body 610 is locked in the cartridge-inserted section 22.

Further, since the unlocking projection portion 220 deforms the lever 628 as shown in FIG. 12C, the protrusion 617 does not fasten the lever 628 and the external cover 620 can rotationally move. The CRG connector 618 contacts a connector provided on the printer body.

2. Regarding Operations of Toner Cartridge, etc. in Closing Movement of Shutter

This section describes operations of the toner cartridge 60, etc. that are carried out until the CRG shutter 630 located at the opening position reaches the closing position, that is, until the state shifts from that shown in FIG. 4 to that shown in FIG. 3.

Since the lever 628 is not fastened by the protrusion 617, a user, etc. pushes (operates) the handle 621 in a predetermined direction (the direction indicated by the arrow in FIG. 4) so that the external cover 620 starts its rotational movement. In rotational movement of the external cover 620, the unlocking projection portion 220 keeps contacting the lever 628, as shown in FIGS. 12B through 12D. Therefore, during rotational movement of the external cover 620, the protrusion 617 does not fasten the lever 628.

With rotational movement of the external cover 620, the CRG shutter 630 moves linearly. In other words, force exerted as a result of the user, etc. pushing the handle 621 is transmitted to the external cover 620 as rotational-movement force that rotationally moves the external cover 620. The external cover 620 moves rotationally with the rack section 632 and the pinion section 622 engaging with each other so that the rotational-movement force is converted into, and is transmitted to the CRG shutter 630 as, linear-movement force that linearly moves the CRG shutter 630, through the pinion section 622 and the rack section 632. Accordingly, the CRG shutter 630 moves linearly by the linear-movement force while contacting the guiding section 614.

A user, etc. pushes the handle 621 from the position shown in FIG. 4 to the position shown in FIG. 3 (in conjunction with this, the external cover 620 rotationally moves) so that the CRG shutter 630 linearly moves from the opening position to the closing position (i.e., carries out closing movement) as shown in FIGS. 15A through 15C. When the handle 621 is pushed to the position shown in FIG. 3, the CRG shutter 630 becomes closed.

Further, when the CRG shutter 630 linearly moves, the engaging piece 636 of the CRG shutter 630 makes the inserted-section shutter 230 move linearly with the shutter 230 contacting the guiding section 280.

That is, when the CRG shutter 630 is located at the opening position, the engaging piece 636 is elastically deformed (projects towards the inserted-section shutter 230) by being pressed by the flat section 616*b* of the rib 616, but the engaging piece 636 does not engage with (does not contact) the engaged hole 234 (note that the engaging piece 636 enters into the engaged hole 234), as shown in FIG. 17A. Immediately after the CRG shutter 630 starts moving from the opening position, the engaging piece 636 that is elastically deformed and projects towards the inserted-section shutter 230 engages with (contacts) the engaged hole 234, as shown in FIG. 17B. When the CRG shutter 630 moves further, the engaging piece 636 pushes (specifically, pushes up) the CRG shutter 630. As a result thereof, the inserted-section shutter 230 moves from the opening position to the closing position shown in FIG. 17C. As mentioned above, the engaging piece 636 has a function of an operating section that engages with the inserted-section shutter 230 and that operates the inserted-section shutter 230 so as to move the shutter 230 from the opening position to the closing position (i.e., so that the shutter 230 carries out closing movement).

When the inserted-section shutter 230 reaches the closing position, the CRG shutter 630 does not reach the closing position. Therefore, after the inserted-section shutter 230 reaches the closing position, the CRG shutter 630 can further move linearly. Further linear movement of the CRG shutter 630 makes the CRG shutter 630 reach the closing position shown in FIG. 17D. In this movement, the engaging piece 636 does not contact the flat section 616*b* (the engaging piece 636 opposes the curved section 616*a*) and is not pushed by the flat section 616*b*. Therefore, the engaging piece 636 does not enter into the engaged hole 234 (thus, the engaging piece 636 does not engage with the engaged hole 234). As mentioned above, the engaging piece 636 that engages with the inserted-section shutter 230 is disengaged from the inserted-section shutter 230 at a certain point in midstream of movement (closing movement) of the CRG shutter 630 from the opening position to the closing position.

When the CRG shutter 630 (the inserted-section shutter 230) linearly moves from the opening position to the closing position, the one-end contacting section 235*a* of the inserted-section shutter 230 does not contact the CRG contacting section 634 of the CRG shutter 630, as shown in FIGS. 17B and 17C. When the inserted-section shutter 230 moves from the opening position to the closing position, the one end 235 of the inserted-section shutter 230 in the transverse direction (the one-end contacting section 235*a*) does not reach a position opposite to the inserted-section seal opening 272, as shown in FIGS. 3 and 4.

Further, the CRG shutter 630 moves from the opening position to the closing position so that the CRG seal opening 642 (the CRG opening 612) is covered by the CRG shutter 630 (FIG. 14A). In a similar manner, the inserted-section shutter 230 moves from the opening position to the closing position so that the inserted-section seal opening 272 (the inserted-section opening 260) is also covered by the inserted-section shutter 230.

A user, etc. pushes the handle 621 from the position shown in FIG. 4 to the position shown in FIG. 3 (in conjunction with this, the external cover 620 rotationally moves) so that the CRG body 610 that is locked in the cartridge-inserted section 22 is released from the cartridge-inserted section 22, as shown in FIGS. 13A and 13B.

In other words, when the handle 621 is located at the position shown in FIG. 4, the hook 626 of the external cover 620 cannot move through the locking hole 210, as shown in FIGS. 13C and 13D. As a result that the handle 621 is pushed, the hook 626 that moves together with movement of the external cover 620 moves to the direction indicated by the arrow in FIG. 13C. When the handle 621 reaches the position shown in FIG. 3, the hook 626 reaches the position shown in FIG. 13A. At this stage, the hook 626 can move through the locking hole 210, as shown in FIG. 13B.

3. Regarding Operations of Toner Cartridge, etc. when Detaching Toner Cartridge

This section describes operations of the toner cartridge 60, etc. when detaching the toner cartridge 60 whose CRG shutter 630 is resting at the closing position from the cartridge-inserted section 22.

When a user, etc. grabs the handle 621 and lifts up the toner cartridge 60 that is inserted into the cartridge-inserted section 22, the toner cartridge 60 is detached from the process unit 20. That is, since, when lifting up the toner cartridge 60, the hook 626 is located at the position shown in FIGS. 13A and 13B, the hook 626 can move through the locking hole 210 and the toner cartridge 60 is detached from the process unit 20.

When the toner cartridge 60 is detached, the external cover 620 is locked so that it cannot rotationally move relative to the CRG body 610. That is, when the toner cartridge 60 is inserted into the cartridge-inserted section 22, the unlocking projection portion 220 deforms the lever 628 by contacting the lever 628 so that the protrusion 617 does not fasten the lever 628, as shown in FIG. 12B; however, when the toner cartridge 60 is detached, the unlocking projection portion 220 does not contact the lever 628 so that the protrusion 617 fastens the lever 628, as shown in FIG. 12A. Thus, when the toner cartridge 60 is detached, the protrusion 617 and the lever 628 lock the external cover 620 so as not to permit the external cover 620 to rotationally move relative to the CRG body 610.

Regarding Effectiveness of Toner Cartridge 60, etc. according to This Embodiment As mentioned above, the developer cartridge (the toner cartridge 60) according to this embodiment includes: the container (the CRG body 610) for containing developer (toner); the shutter (the CRG shutter 630) that is supported so that the shutter can linearly move relative to the CRG body 610, and that opens and closes by moving linearly; the handle member (the external cover 620) that is supported so that the handle member can rotationally move relative to the CRG body 610, and that includes the handle 621; and the conversion mechanism (the rack section 632 and the pinion section 622) by which rotational-movement force that rotationally moves the external cover 620 is converted into linear-movement force that linearly moves the CRG shutter 630. Accordingly, this allows the CRG shutter 630 to open and close properly in a simple configuration. A detail thereof is described hereinbelow.

As in the preceding, in order to move toner inside the CRG body 610 to the outside thereof (specifically, to supply the toner containing section 51 with toner inside the CRG body 610), it is necessary to properly open and close the CRG shutter 630. On the other hand, if a complicated mechanism is provided in order to properly open and close the CRG shutter 630, there is a risk that it induces increase of the number of components.

In contrast, in this embodiment, as shown in FIGS. 15A through 15C, the conversion mechanism (the rack section 632 provided on the CRG shutter 630, and the pinion section 622 provided on the external cover 620) converts rotational-movement force that rotationally moves the external cover 620 into linear-movement force that linearly moves the CRG shutter 630. Specifically, when force exerted as a result of a user, etc. pushing the handle 621 of the external cover 620 is transmitted to the external cover 620 as rotational-movement force that rotationally moves the external cover 620, the external cover 620 moves rotationally with the rack section 632 and the pinion section 622 engaging with each other. As a result thereof, via the pinion section 622 and the rack section 632, the rotational-movement force is converted into linear-movement force that linearly moves the CRG shutter 630 and is transmitted to the CRG shutter 630. Accordingly, the CRG shutter 630 moves linearly by the linear-movement force, and the CRG shutter 630 opens and closes.

Thus, the rotational-movement force that rotationally moves the external cover 620 is utilized through the conversion mechanism and linearly moves the CRG shutter 630 so that the shutter 630 opens and closes. Accordingly, this allows the CRG shutter 630 to open and close properly in a simple configuration.

Besides, in this embodiment, as shown in FIG. 12B, after the external cover 620 that is locked in the CRG body 610 is released from the CRG body 610 by the unlocking projection portion 220, when the handle 621 is operated and the external cover 620 moves rotationally, the conversion mechanism converts the rotational-movement force into the linear-movement force so that the CRG shutter 630 moves linearly and opens. Accordingly, the CRG shutter 630 opens after the toner cartridge 60 is inserted into the cartridge-inserted section 22. Therefore, it is possible to surely prevent the CRG shutter 630 from opening incorrectly when the toner cartridge 60 is not inserted into the cartridge-inserted section 22.

Further, as mentioned above, the second shutter (the CRG shutter 630) of the image forming apparatus according to this embodiment (the printer 10) includes the operating section (the engaging piece 636) that engages with the first shutter (the inserted-section shutter 230) and operates the inserted-section shutter 230, and whose engagement with the inserted-section shutter 230 is disengaged at a certain point during closing movement from the second opening position (the opening position of the CRG shutter 630) at which the CRG shutter 630 exposes the second opening (the CRG seal opening 642) to the second closing position (the closing position of the CRG shutter 630) at which the CRG shutter 630 covers the CRG seal opening 642, as shown in FIGS. 17A through 17D. Accordingly, it is possible to properly open and close the inserted-section shutter 230 and the CRG shutter 630 in a simple configuration. A detail thereof is described hereinbelow.

As in the preceding, as a configuration which to open and close the inserted-section shutter 230 and the CRG shutter 630, two configurations are proposed: one is a configuration in which the inserted-section shutter 230 and the CRG shutter 630 each move and open/close independently, and the other is a configuration in which one of the two shutters moves and opens/closes in conjunction with movement of the other shutter.

However, the former of the above-mentioned two configurations is likely to induce increase of the number of components. On the other hand, in the latter configuration, movement of the inserted-section shutter 230 and the CRG shutter 630 is likely to be restricted. For example, assume that one of the two shutters presses the other one and moves from its opening position to its closing position. In such a case, the other shutter is pressed by the one shutter and thereby moves from its opening position to its closing position. Therefore, the two shutters stops simultaneously, and this restricts movement of the inserted-section shutter 230 and the CRG shutter 630.

In contrast, in this embodiment, as shown in FIGS. 17A through 17D, the engaging piece 636 that has engaged with the inserted-section shutter 230 (specifically, the engaged hole 234) is disengaged from the inserted-section shutter 230 at a certain point during closing movement in which the engaging piece 636 of the CRG shutter 630 moves from the second opening position to the second closing position.

In such a case, the engaging piece 636 that engages with the inserted-section shutter 230 is disengaged from the inserted-section shutter 230 at a certain point during closing movement of the CRG shutter 630 (the inserted-section shutter 230 reaches the closing position immediately before the engaging piece 636 is disengaged). Therefore, after the inserted-section shutter 230 reaches the closing position, the CRG shutter 630 can further move (in other words, the inserted-section shutter 230 and the CRG shutter 630 each stop non-simultaneously). Accordingly, it is possible to move the inserted-section shutter 230 and the CRG shutter 630 to their respective appropriate closing positions and to close the shutters in a simple configuration without increasing the number of components.

Further, in this embodiment in which the engaging piece 636 is provided on the CRG shutter 630 of the toner cartridge 60, there is especially effectiveness in that a time when the inserted-section shutter 230 reaches the closing position is different from a time when the CRG shutter 630 reaches the closing position. That is, when the inserted-section shutter 230 is located at the closing position, the engaging piece 636 enters into and engages with the engaged hole 234 as shown in FIG. 17C; however, when the CRG shutter 630 is located at the closing position, the engaging piece 636 does not enter into the engaged hole 234 as shown in FIG. 17D. Therefore, when the toner cartridge 60 is detached from the cartridge-inserted section 22 with the CRG shutter 630 being located at the closing position, the engaging piece 636 does not hook onto the engaged hole 234. Accordingly, it is possible to properly detach the toner cartridge 60.

In the above-mentioned embodiment, the operating section that has engaged with the inserted-section shutter 230 is disengaged from the inserted-section shutter 230 at a certain point during the above-mentioned closing movement of the CRG shutter 630. However, the invention is not limited thereto. For example, the operating section that has engaged with the inserted-section shutter 230 may be disengaged from the inserted-section shutter 230 at a certain point during opening movement of the CRG shutter 630 from the second closing position to the second opening position. In such a case, it is possible to move the inserted-section shutter 230 and the CRG shutter 630 to their respective appropriate opening positions and to open the shutters in a simple configuration.

The operating section engaging with the inserted-section shutter 230 may be disengaged from the inserted-section shutter 230 during both of the above-mentioned opening movement and closing movement of the CRG shutter 630. In such a case, it is possible to move the inserted-section shutter 230 and the CRG shutter 630 to their respective appropriate opening positions and closing positions and to open/close the shutters in a simple configuration. Accordingly, if the operating section engaging with the inserted-section shutter 230 is disengaged from the inserted-section shutter 230 at a certain point during at least either one of the above-mentioned opening movement and closing movement of the CRG shutter 630, it is possible to properly open/close the inserted-section shutter 230 and the CRG shutter 630 in a simple configuration.

Furthermore, as mentioned above, the shutter device according to this embodiment (the second shutter device is described below as an example) includes: the sealing member (the CRG seal 640) that includes an opening through which developer (toner) can pass, and that is for preventing toner from spilling; and the shutter (the CRG shutter 630) that includes the opening (the CRG shutter opening 631) being larger than the opening (the CRG seal opening 642) of the CRG seal 640, and that can move between the first position (the closing position) at which the CRG shutter 630 covers the CRG seal opening 642 and the second position (the opening position) at which the CRG shutter 630 exposes the CRG seal opening 642. Besides, when the CRG shutter 630 is located at the opening position, the CRG shutter 630 presses the CRG seal 640 in a state where the entire edge section 631*a*, of the CRG shutter 630, around the opening (the CRG shutter opening 631) surrounds the entire edge section 642*a* around the CRG seal opening 642. Accordingly, it is possible to sufficiently prevent toner from spilling. A detail thereof is described hereinbelow.

As in the preceding, when the CRG shutter 630 opens (in other words, the CRG shutter 630 is located at the opening position), there is a risk that the CRG seal 640 cannot sufficiently prevent toner from spilling.

Figure 19A:
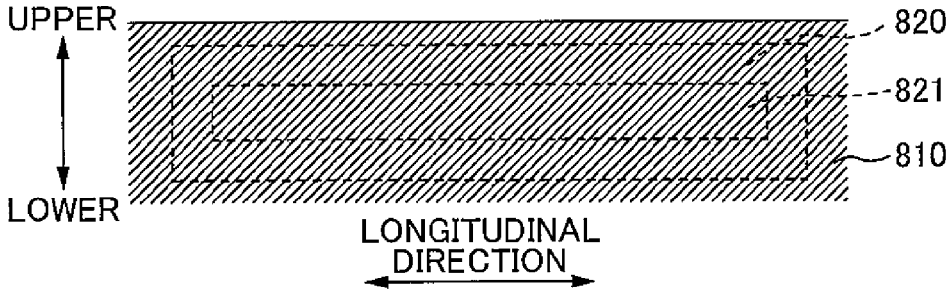
FIG. 19A is a diagram showing a CRG shutter 810 and a CRG seal 820 under a situation in which the CRG shutter 810 closes.
Figure 19B:
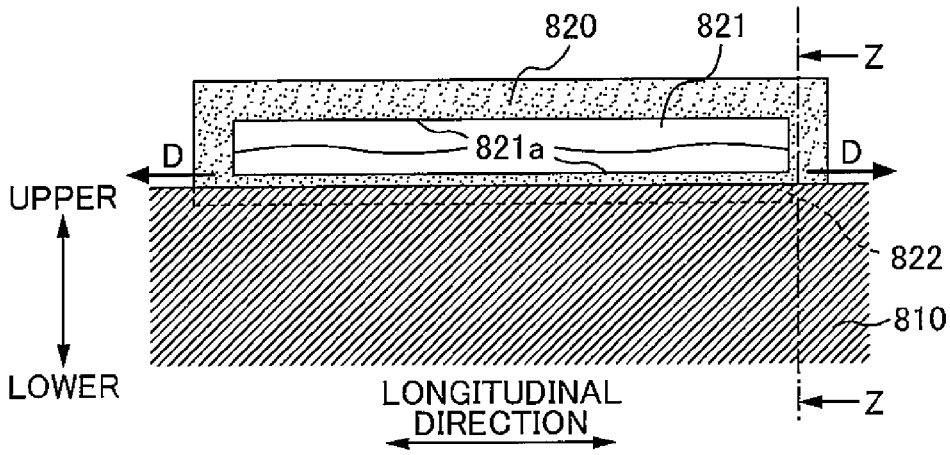
FIG. 19B is a diagram showing the CRG shutter 810 and the CRG seal 820 under a situation in which the CRG shutter 810 opens.
Figure 19C:
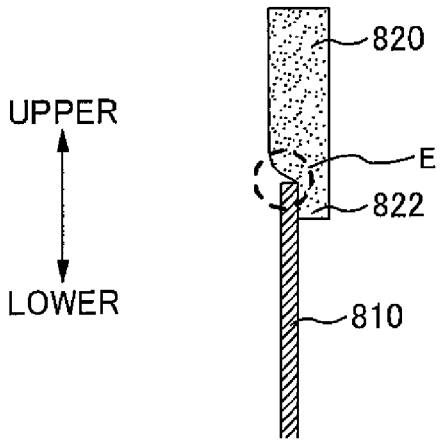
FIG. 19C is a cross-sectional view taken along line Z-Z of FIG. 19B.

A specific explanation is given hereinbelow with reference to a comparison example shown in FIGS. 19A through 19C. FIG. 19A is a diagram showing a CRG shutter 810 and a CRG seal 820 under a situation in which the CRG shutter 810 closes. FIG. 19B is a diagram showing the CRG shutter 810 and the CRG seal 820 under a situation in which the CRG shutter 810 opens. FIG. 19C is a cross-sectional view taken along line Z-Z of FIG. 19B. The CRG seal 820 according to the comparison example is furnished with a CRG seal opening 821 in the same manner as the CRG seal 640 according to this embodiment; however, the CRG shutter 810 according to the comparison example is not furnished with a CRG shutter opening unlike the CRG shutter 630 according to this embodiment. When the CRG shutter 810 covers the CRG seal opening 821, the CRG shutter 810 is located at a position at which the CRG shutter 810 covers the CRG seal 820, as shown in FIG. 19A; when the CRG shutter 810 exposes the CRG seal opening 821, the CRG shutter 810 is entirely located lower than the CRG seal 820 in the up-and-down direction shown in FIG. 19B.

As shown in FIG. 19B, when the CRG shutter 810 opens, the CRG shutter 810 presses only a lower section 822 of the CRG seal 820 in the up-and-down direction shown in FIG. 19B so as to compress the lower section 822. Note that a section that is not pressed by the CRG shutter 810 (that is, an upper section of the up-and-down direction) is released from compression by the CRG shutter 810, as shown in FIG. 19C. This forms a section (the section E shown in FIG. 19C) at which a thickness of the CRG seal 820 changes steeply in the circumferential section of the CRG seal opening 821. The section E does not properly contact the opposing member (that is, the inserted-section seal 270 or the inserted-section shutter 230) that the CRG seal 820 opposes, and therefore, a gap is formed between the section E and the opposing member. Accordingly, there is a risk that toner moving from the toner cartridge 60 to the toner containing section 51 moves along the gap towards the outside of the CRG seal opening 821 from the inside thereof in the longitudinal direction of FIG. 19B (to a direction indicated by the arrow D in FIG. 19B), and spills outside.

In contrast, in this embodiment, as shown in FIG. 18A, the CRG shutter 630 includes the CRG shutter opening 631 being larger than the CRG seal opening 642, and, when being located at the opening position, presses the CRG seal 640 in a state where the entire edge section 631*a* around the CRG shutter opening 631 surrounds the entire edge section 642*a* around the CRG seal opening 642. In such a case, the circumferential section of the CRG seal opening 642 (a section corresponding to the dashed line F in FIG. 18A) is pressed evenly. As a result thereof, the circumferential section of the CRG seal opening 642 properly contacts the opposing member (the inserted-section seal 270 or the inserted-section shutter 230). Therefore, the above-mentioned gap is less likely to be formed, and it is possible to sufficiently prevent toner moving between the toner cartridge 60 and the toner containing section 51 from spilling.

In the above description, the second shutter device (the CRG seal 640 and the CRG shutter 630) is described as an example of the shutter device, but a similar effect is also achieved on the first shutter device (the inserted-section seal 270 and the inserted-section shutter 230). That is, as shown in FIG. 18B, the inserted-section shutter 230 includes the inserted-section shutter opening 232 being larger than the inserted-section seal opening 272, and, when being located at the opening position, presses the inserted-section seal 270 in a state where the entire edge section 232*a* around the inserted-section shutter opening 232 surrounds the entire edge section 272*a* around the inserted-section seal opening 272. Accordingly, the circumferential section of the inserted-section seal opening 272 (a section corresponding to the dashed line G in FIG. 18B) properly contacts the opposing member (the CRG seal 640 or the CRG shutter 630). Therefore, it is possible to sufficiently prevent toner moving between the toner cartridge 60 and the toner containing section 51 from spilling.

Other Embodiments

The toner cartridge, etc. according to the invention is described above based on the above-mentioned embodiment. However, the above-mentioned embodiment of the invention is provided for facilitating the understanding of the invention, and is not to be interpreted as limiting the invention. As a matter of course, the invention can be altered and improved without departing from the gist thereof and the invention includes equivalents thereof.

In the above-mentioned embodiment, a monochrome printer having one photoconductor 31 and one developing section 50 was described as an example of the image forming apparatus, but the invention is not limited thereto. For example, the invention is also applicable to a color printer (a so-called tandem-engine printer) having photoconductors 31 and developing sections 50 that are dedicated to and independent among each color. In such a case, the toner cartridge 60 is provided for each color; each toner cartridge 60 is attached to and detached from its own predetermined cartridge-inserted section, and toner inside the toner cartridge 60 is supplied to a developing section corresponding to each toner cartridge 60.

Besides, in the above-mentioned embodiment, the toner cartridge 60 is attached to and detached from the process unit 20 that is mounted on the printer body, but the invention is not limited thereto. For example, the process unit 20 may be a cartridge that can be attached to and detached from the printer body, and the toner cartridge 60 may be attached to and detached from this process unit 20 while this process unit 20 is detached from the printer body. In such a case, the process unit 20 having the toner cartridge 60 attached thereto is attached to and detached from the printer body.

Further, in the above-mentioned embodiment, as shown in FIGS. 15A through 15C, the conversion mechanism includes the rack section 632 that is provided to the CRG shutter 630, and the pinion section 622 that is provided to the external cover 620 and that can engage with the rack section 632. Besides, the CRG shutter 630 moves linearly as a result that the rotational-movement force is converted into the linear-movement force due to the external cover 620 moving rotationally in a state where the rack section 632 and the pinion section 622 are engaged with each other. However, the invention is not limited thereto. For example, the conversion mechanism may consist of anything other than the rack section and the pinion section.

However, if the conversion mechanism includes the rack section 632 and the pinion section 622, it is possible to easily convert the rotational-movement force that rotationally moves the external cover 620 into the linear-movement force that linearly moves the CRG shutter 630. Accordingly, the above-mentioned embodiment is more preferable.

Further, in the above-mentioned embodiment, the CRG shutter 630 is made of metal, and the external cover 620 is made of resin. Beside, as shown in FIGS. 15A through 15C, the rack section 632 consists of the plurality of holes 633 that are provided at regular intervals, and the pinion section 622 consists of the plurality of projections 623 that are provided at regular intervals and that can engage with the holes 633. However, the invention is not limited thereto. For example, the rack section 632 may consist of a plurality of projections that are provided at regular intervals and that can engage with the projections 623 constituting the pinion section 622.

However, if the CRG shutter 630 is made of metal, holes are easier to be processed than projections. Therefore, if the rack section consists of holes, it is possible to easily form the rack section. Accordingly, the above-mentioned embodiment is more preferable.

Further, in the above-mentioned embodiment, as shown in FIG. 6, the toner cartridge 60 includes the handle-member locking section (specifically, the protrusion 617 and the lever 628) for locking the external cover 620 so that the external cover 620 cannot rotationally move relative to the CRG body 610; as shown in FIG. 10, the image-forming-apparatus body (the process unit 20 of the printer body) includes the unlocking section (the unlocking projection portion 220) for releasing the locking between the external cover 620 and the CRG body 610, and the cartridge-inserted section 22 into which the toner cartridge 60 is inserted. Besides, as shown in FIG. 12A, when the toner cartridge 60 is not inserted into the cartridge-inserted section 22, the locking by the handle-member locking section restricts the rotational movement of the external cover 620 relative to the CRG body 610; and, as shown in FIG. 12B, when the toner cartridge 60 is inserted into the cartridge-inserted section 22, the locking is released by the unlocking projection portion 220 so that the rotational movement of the external cover 620 is allowed. However, the invention is not limited thereto. For example, a dedicated member that is for releasing the locking after the toner cartridge 60 is inserted into the cartridge-inserted section 22 may be provided separately.

However, if the toner cartridge 60 includes the handle-member locking section (the protrusion 617 and the lever 628) and the process unit 20 includes the unlocking projection portion 220, it is possible to realize a simple configuration which can surely prevent the external cover 620 from rotating incorrectly (prevent the CRG shutter 630 from opening incorrectly) when the toner cartridge 60 is not inserted into the cartridge-inserted section 22. Accordingly, the above-mentioned embodiment is more preferable.

Further, in the above-mentioned embodiment, as shown in FIG. 6, the handle-member locking section includes the protruding section (the lever 628) that is provided on the external cover 620, and the fastening section (the protrusion 617) that is provided to the CRG body 610 and that can fasten the lever 628. Besides, as shown in FIG. 10, the unlocking projection portion 220 is the projection portion that deforms the lever 628 by contacting the lever 628. Further, as shown in FIG. 12A, when the toner cartridge 60 is not inserted into the cartridge-inserted section 22, the lever 628 is fastened by the protrusion 617; as shown in FIG. 12B, when the toner cartridge 60 is inserted into the cartridge-inserted section 22, the unlocking projection portion 220 deforms the lever 628 so that the fastening of the lever 628 by the protrusion 617 is released. However, the invention is not limited thereto. For example, the handle-member locking section may consist of anything other than the lever 628 and the protrusion 617, and the unlocking section may consist of anything other than the projection portion that deforms the lever 628.

However, if the handle-member locking section includes the lever 628 and the protrusion 617, and if the unlocking section is the projection portion, the lever 628 can be easily fastened by the protrusion 617 and the fastening of the lever 628 by the protrusion 617 can be easily released. Therefore, it is possible to realize a simple configuration that can lock the external cover 620 to the CRG body 610 and release the locking between the external cover 620 and the CRG body 610. Accordingly, the above-mentioned embodiment is more preferable.

Further, in the above-mentioned embodiment, the toner cartridge 60 is attached to the printer body (the process unit 20) by rotationally moving the external cover 620 to a predetermined position (the position shown in FIG. 4) after the toner cartridge 60 is inserted into the cartridge-inserted section 22. Besides, the printer 10 includes the container-locking section that is for locking the CRG body 610 to the cartridge-inserted section 22. Further, the container-locking section includes the hook 626 (FIG. 5) that is provided to the external cover 620, and that moves with rotational movement of the external cover 620, and the hole section (the locking hole 210, FIG. 10) that is provided in the cartridge-inserted section 22, and through which the hook 626 can move, as shown in FIGS. 13A and 13B, when the toner cartridge 60 is inserted into the cartridge-inserted section 22, and through which the hook 626 cannot move, as shown in FIGS. 13C and 13D, when the toner cartridge 60 is attached to the printer body. However, the invention is not limited thereto. For example, the container-locking section may consist of anything other than the hook 626 and the locking hole 210.

However, if the container-locking section includes the hook 626 and the locking hole 210, it is possible to realize a simple configuration which can lock the CRG body 610 to the cartridge-inserted section 22 and release the locking between the CRG body 610 and the cartridge-inserted section 22. Accordingly, the above-mentioned embodiment is more preferable.

Further, in the above-mentioned embodiment, when the external cover 620 rotationally moves to the predetermined position (the position shown in FIG. 4), the conversion mechanism (the rack section 632 and the pinion section 622) converts the rotational-movement force into the linear-movement force so that the CRG shutter 630 opens. Besides, when the toner cartridge 60 is attached to the printer body (the process unit 20), the CRG shutter 630 opens as shown in FIG. 14B, and the CRG body 610 is locked to the cartridge-inserted section 22 by the container-locking section (the hook 626 and the locking hole 210), as shown in FIGS. 13C and 13D. However, the invention is not limited thereto. For example, it is acceptable that, when the toner cartridge 60 gets attached to the process unit 20, the CRG shutter 630 opens and the CRG body 610 is not locked to the cartridge-inserted section 22, and that, after the toner cartridge 60 is completely attached to the process unit 20, the CRG body 610 is locked in the cartridge-inserted section 22.

However, if, when the toner cartridge 60 gets attached to the printer body, the CRG shutter 630 opens and the CRG body 610 gets locked to the cartridge-inserted section 22, this reduces burden of a user, etc. who has to operate units after the attaching. Therefore, it is possible to realize a convenient printer 10. Accordingly, the above-mentioned embodiment is more preferable.

Further, in the above-mentioned embodiment, as shown in FIG. 3, the printer 10 includes: the image-forming unit (the process unit 20) that includes the image-bearing body (the photoconductor 31) for bearing a latent image, the containing section (the toner containing section 51) for containing developer (toner), and the developer-bearing body (the developing roller 52) for making the latent image borne by the photoconductor 31 visible using the toner as a developer image (a toner image); and the developer cartridge (the toner cartridge 60) that can be attached to and detached from the process unit 20, and that is for supplying the toner containing section 51 with toner. Besides, the first opening (the inserted-section seal opening 272) and the first shutter (the inserted-section shutter 230) are provided to the process unit 20, and the second opening (the CRG seal opening 642) and the second shutter (the CRG shutter 630) are provided to the toner cartridge 60. However, the invention is not limited thereto. For example, the first opening and the first shutter may be provided to any unit other than the process unit 20; the second opening and the second shutter may be provided to any unit other than the toner cartridge 60.

However, if the first opening and the first shutter are provided to the process unit 20, and if the second opening and the second shutter are provided to the toner cartridge 60, when, for example, the toner cartridge 60 contains a small amount of toner, the toner cartridge 60 is frequently attached and detached so that the two shutters frequently opens and closes. In such a case, if the engaging piece 636 according to this embodiment is provided, an effect that the two shutters can properly open and close in a simple configuration is achieved more effectively. Accordingly, the above-mentioned embodiment is more preferable.

Further, in the above-mentioned embodiment, as shown in FIGS. 17A through 17D, the engaging piece 636 engages with the inserted-section shutter 230 by elastic deformation of the engaging piece 636, and the engaging piece 636 that engages with the inserted-section shutter 230 is disengaged from the inserted-section shutter 230 by elastic deformation of the engaging piece 636. However, the invention is not limited thereto. For example, the operating section may engage with the inserted-section shutter 230 by movement of the operating section without elastic deformation, and the operating section that engages with the inserted-section shutter 230 may be disengaged from the inserted-section shutter 230 by movement of the operating section without elastic deformation.

However, if the engaging piece 636 engages with the inserted-section shutter 230 by elastic deformation of the engaging piece 636 and the engaging piece 636 that engages with the inserted-section shutter 230 is disengaged from the inserted-section shutter 230 by elastic deformation of the engaging piece 636, it is possible to realize a simple configuration in which the engaging piece 636 can engage with the inserted-section shutter 230 and the engaging piece 636 engaging with the inserted-section shutter 230 can be disengaged from the inserted-section shutter 230. Accordingly, the above-mentioned embodiment is more preferable.

Further, in the above-mentioned embodiment, the longitudinal direction of the inserted-section shutter 230 is along the longitudinal direction of the CRG shutter 630; the engaging piece 636 is an elastic metal piece that is located near both ends of the CRG shutter 630 in its longitudinal direction, as shown in FIG. 5. Besides, the inserted-section shutter 230 has the engaged-hole section (the engaged hole 234) with which the engaging piece 636 can engage near both ends of the inserted-section shutter 230 in its longitudinal direction, as shown in FIG. 11; the toner cartridge 60 includes the protrusion (the rib 616) that pushes the engaging piece 636 so as to project towards the inserted-section shutter 230 when the CRG shutter 630 moves, as shown in FIG. 7. Further, as shown in FIGS. 17A through 17D, the engaging piece 636 projects towards the inserted-section shutter 230 and can engage with the engaged hole 234 when being pushed by the rib 616 (specifically, the flat section 616*b*), and does not project and cannot engage with the engaged hole 234 when not being pushed by the rib 616. However, the invention is not limited thereto. Another configuration is also acceptable in which the engaging piece 636 engages with the inserted-section shutter 230 by elastic deformation of the engaging piece 636.

However, in the event that the engaging piece 636 is an elastic metal piece, that the inserted-section shutter 230 has the engaged hole 234 with which the engaging piece 636 can engage, and that the engaging piece 636 engages with the engaged hole 234 as a result of being pushed by the rib 616 (specifically, the flat section 616*b*), it is possible to realize a simple configuration in which the engaging piece 636 can engage with the inserted-section shutter 230. Accordingly, the above-mentioned embodiment is more preferable.

Further, in the above-mentioned embodiment, as shown in FIGS. 16A through 16C, the CRG shutter 630 has the CRG contacting section 634 that can contact the inserted-section shutter 230 when moving from the closing position to the opening position. Besides, the inserted-section shutter 230 moves from the closing position to the opening position as a result that the CRG contacting section 634 contacts and pushes the inserted-section shutter 230 when the CRG shutter 630 moves. However, the invention is not limited thereto. For example, the contacting section may move the inserted-section shutter 230 from the opening position to the closing position.

Further, in the above-mentioned embodiment, as shown in FIG. 17A, when the CRG shutter 630 is located at the opening position, the engaging piece 636 does not engage with the inserted-section shutter 230. Besides, as shown in FIGS. 17B and 17C, the engaging piece 636 engages with and operates the inserted-section shutter 230 only during a certain period in midstream of the movement of the CRG shutter 630 from the opening position to the closing position; and the inserted-section shutter 230 is operated by the engaging piece 636 and moves from the opening position to the closing position. However, the invention is not limited thereto.

For example, it is also acceptable that the engaging piece 636 engages with the inserted-section shutter 230 when the CRG shutter 630 is located at the opening position, and that the engaging piece 636 keeps engaging with the CRG shutter 630 until a certain point in midstream of the closing movement of the CRG shutter 630 and moves the inserted-section shutter 230 from the opening position to the closing position.

Further, in the above-mentioned embodiment, as shown in FIG. 5, the CRG contacting section 634 is the extending section that extends towards the inserted-section shutter 230 at one end in the transverse direction of the CRG shutter 630; as shown in FIG. 11, the inserted-section shutter 230 has the projecting section 231 that is located on the central section in the longitudinal direction of the inserted-section shutter 230 and that projects towards the CRG shutter 630. Besides, as shown in FIGS. 16A through 16C, the inserted-section shutter 230 moves from the closing position to the opening position as a result that the extending section (the CRG contacting section 634) contacts and pushes one end of the projecting section 231 in the transverse direction of the inserted-section shutter 230 when the CRG shutter 630 moves. However, the invention is not limited thereto. For example, the inserted-section shutter 230 may be a flat plate without the projecting section 231.

However, if the inserted-section shutter 230 has the projecting section 231, and if the inserted-section shutter 230 moves as a result that the extending section (the CRG contacting section 634) contacts and pushes the projecting section 231 when the CRG shutter 630 moves, the CRG contacting section 634 contacts the inserted-section shutter 230 surely. Therefore, the inserted-section shutter 230 can surely move from the closing position to the opening position. Accordingly, the above-mentioned embodiment is more preferable.

Further, in the above-mentioned embodiment, as shown in FIGS. 16A through 16C, when the CRG shutter 630 moves from the closing position to the opening position (opening movement), the CRG contacting section 634 contacts the inserted-section shutter 230, whereas the engaging piece 636 does not engage with the inserted-section shutter 230; as shown in FIGS. 17A through 17D, when the CRG shutter 630 moves from the opening position to the closing position (closing movement), the engaging piece 636 engages with the inserted-section shutter 230, whereas the CRG contacting section 634 does not contact the inserted-section shutter 230. However, the invention is not limited thereto. For example, in the above-mentioned opening movement and closing movement of the CRG shutter 630, the CRG contacting section 634 may contact the inserted-section shutter 230 and also the engaging piece 636 may engage with the inserted-section shutter 230.

If, when the CRG contacting section 634 moves the inserted-section shutter 230 from the closing position to the opening position (opening movement), the engaging piece 636 engages with the inserted-section shutter 230 so as to interfere with the opening movement, the CRG contacting section 634 contacts insufficiently the inserted-section shutter 230. As a result thereof, there is a risk that the CRG contacting section 634 does not sufficiently function to cause the inserted-section shutter 230 to carry out opening movement. In a similar manner, if, when the engaging piece 636 moves the inserted-section shutter 230 from the opening position to the closing position (closing movement), the CRG contacting section 634 contacts the inserted-section shutter 230 so as to interfere with the closing movement, the engaging piece 636 engages insufficiently with the inserted-section shutter 230. As a result thereof, there is a risk that the engaging piece 636 does not sufficiently function to cause the inserted-section shutter 230 to carry out closing movement. In contrast, if, like the above-mentioned embodiment, the engaging piece 636 does not engage with the inserted-section shutter 230 in the opening movement and the CRG contacting section 634 does not contact the inserted-section shutter 230 in the closing movement, the CRG contacting section 634 and the engaging piece 636 can each function sufficiently. Accordingly, the above-mentioned embodiment is more preferable.

Further, in the above-mentioned embodiment, as shown in FIGS. 14A and 14B, the printer 10 includes two of the shutter devices; the two shutter devices are provided adjacent to each other such that toner can move between the openings of the sealing members (the CRG seal 640 and the inserted-section seal 270) when each of the shutters (the CRG shutter 630 and the inserted-section shutter 230) is located at the opening position. Besides, as shown in FIG. 11B, the CRG seal 640 that is pressed by the CRG shutter 630 and the inserted-section seal 270 that is pressed by the inserted-section shutter 230 contact each other when the CRG shutter 630 and the inserted-section shutter 230 of the two shutter devices are located at the opening position. However, the invention is not limited thereto.

For example, the printer 10 does not have to include two adjacent shutter devices, that is, a shutter device may oppose an opposing member including an opening, and, when a shutter of the shutter device opens, a sealing member that is exposed at this time may contact the opposing member.

Further, in the above-mentioned embodiment, as shown in FIG. 14C, the edge section 642*a* of the CRG seal 640 that is pressed by the CRG shutter 630 and the edge section 272*a* of the inserted-section seal 270 that is pressed by the inserted-section shutter 230 are sandwiched between the CRG shutter 630 and the inserted-section shutter 230 of the two shutter devices when the CRG shutter 630 and the inserted-section shutter 230 are located at the opening position. However, the invention is not limited thereto. For example, the edge section 642*a* of the CRG seal 640 and the edge section 272*a* of the inserted-section seal 270 may contact each other without being sandwiched between the two shutters (the CRG shutter 630 and the inserted-section shutter 230) when the two shutters are located at the opening position.

However, if, when the two shutters (the CRG shutter 630 and the inserted-section shutter 230) are located at the opening position, the edge section 642*a* of the CRG seal 640 and the edge section 272*a* of the inserted-section seal 270 are sandwiched between the two shutters, it is possible to effectively prevent toner from spilling from between the two shutters. Accordingly, the above-mentioned embodiment is more preferable.

Further, in the above-mentioned embodiment, as shown in FIG. 3, the two shutter devices are the first shutter device provided to the image-forming unit (the process unit 20) that includes the image-bearing body (the photoconductor 31) for bearing a latent image, the containing section (the toner containing section 51) for containing toner, and the developer-bearing body (the developing roller 52) for making the latent image borne by the photoconductor 31 visible using the toner as a developer image (a toner image), and the second shutter device provided to the developer cartridge (the toner cartridge 60) that can be attached to and detached from the process unit 20, and that is for supplying the toner containing section 51 with toner. However, the invention is not limited thereto. For example, the printer 10 may include a cleaning unit that removes toner on the photoconductor 31 and a waste toner box that can be attached to and detached from the printer body and to which toner collected by the cleaning unit is carried, and the two shutter devices may be provided to the cleaning unit and the waste toner box.

However, if the two shutter devices are provided to the process unit 20 and the toner cartridge 60 that supplies the process unit 20 with toner, an amount of toner passing through between the two shutter devices increases. Therefore, it is possible to more effectively achieve an effect generated by providing the above-mentioned shutter devices, that is, an affect that toner is sufficiently prevented from spilling. Accordingly, the above-mentioned embodiment is more preferable.

Further, in the above-mentioned embodiment, as shown in FIGS. 16A through 16C, the inserted-section shutter 230 includes the contacting section (the one-end contacting section 235*a*) that contacts the CRG shutter 630 when the inserted-section shutter 230 moves from the closing position to the opening position; and when the inserted-section shutter 230 moves from the opening position to the closing position, the one-end contacting section 235*a* does not reach a position opposite to the inserted-section seal opening 272 of the inserted-section seal 270. However, the invention is not limited thereto. For example, when the inserted-section shutter 230 moves from the opening position to the closing position, the contacting section may reach the position opposite to the inserted-section seal opening 272.

If, when the inserted-section shutter 230 moves from the opening position to the closing position, the contacting section reaches the position opposite to the inserted-section seal opening 272, there is a risk that the CRG shutter 630 becomes dirtied as a result that toner near the inserted-section seal opening 272 adheres to the contacting section and the contacting section contacts the CRG shutter 630. In contrast, if, when the inserted-section shutter 230 moves from the opening position to the closing position, the contacting section (the one-end contacting section 235*a*) does not reach the position opposite to the inserted-section seal opening 272, toner near the inserted-section seal opening 272 is less likely to adhere to the one-end contacting section 235*a*. Therefore, it is possible to prevent the CRG shutter 630 from being dirtied by the toner. Accordingly, the above-mentioned embodiment is more preferable.

Further, in the above-mentioned embodiment, the inserted-section seal 270 and the CRG seal 640 are made of urethane foam; each of the inserted-section shutter 230 and the CRG shutter 630 is a metal plate whose thickness is less than a thickness of each of the inserted-section seal 270 and the CRG seal 640. However, the invention is not limited thereto. For example, the inserted-section shutter 230 and the CRG shutter 630 may be resin plates.

However, if the inserted-section shutter 230 and the CRG shutter 630 are both metal plates, their thickness can made be less than in a case where the shutters are resin plates. Therefore, when the two shutters open, the inserted-section seal 270 and the CRG seal 640 are more likely to contact each other, so that it is possible to effectively prevent toner from spilling. Accordingly, the above-mentioned embodiment is more preferable.

What is claimed is:

1. A shutter device that prevents developer from spilling, the shutter device comprising:

a sealing member that includes an opening and that is compressible; and a shutter that includes an opening larger than an entire edge section of the opening of the sealing member, the sealing member being fixed to a wall member different from the shutter device in such a manner that an opening of the wall member opposes the opening of the sealing member, the sealing member being compressed between the wall member and the shutter at a position where the opening of the shutter and the opening of the sealing member oppose each other, and when the shutter and an opposing member different from the shutter device are oppositely located, the entire edge section of the opening of the sealing member that opposes the opening of the shutter being capable of contacting the opposing member.

2. A developer cartridge, comprising:

a container for containing developer;

the shutter device according to claim 1, the shutter being supported so that the shutter can linearly move relative to the container, and being capable of opening and closing by moving linearly;

a handle member that is supported so that the handle member can rotationally move relative to the container, and that includes a handle; and a conversion mechanism by which rotational-movement force that rotationally moves the handle member is converted into linear-movement force that linearly moves the shutter.

3. A developer cartridge according to claim 2, wherein:

the conversion mechanism includes a rack section that is provided to the shutter, and a pinion section that is provided to the handle member and that can engage with the rack section; and the shutter moves linearly as a result that the rotational-movement force is converted into the linear-movement force due to the handle member moving rotationally in a state where the rack section and the pinion section are engaged with each other.

4. A developer cartridge according to claim 3, wherein:

the shutter is made of metal;

the handle member is made of resin;

the rack section consists of a plurality of holes that are provided at regular intervals; and the pinion section consists of a plurality of projections that are provided at regular intervals and that can engage with the holes.

5. An image forming apparatus, comprising:

an image-forming-apparatus body; and a developer cartridge that can be attached to and be detached from the image-forming-apparatus body, and that includes a container for containing developer, the shutter device according to claim 1, the shutter being supported so that the shutter can linearly move relative to the container, and being capable of opening and closing by moving linearly, a handle member that is supported so that the handle member can rotationally move relative to the container, and that includes a handle, and a conversion mechanism by which rotational-movement force that rotationally moves the handle member is converted into linear-movement force that linearly moves the shutter.

6. An image forming apparatus according to claim 5, wherein:

the developer cartridge includes a handle-member locking section for locking the handle member so that the handle member cannot rotationally move relative to the container;

the image-forming-apparatus body includes an unlocking section for releasing the locking between the handle member and the container, and a cartridge-inserted section into which the developer cartridge is inserted;

when the developer cartridge is not inserted into the cartridge-inserted section, the locking by the handle-member locking section restricts the rotational movement of the handle member relative to the container; and when the developer cartridge is inserted into the cartridge-inserted section, the locking is released by the unlocking section so that the rotational movement of the handle member is allowed.

7. An image forming apparatus according to claim 6, wherein:

the handle-member locking section includes a protruding section that is provided on the handle member, and a fastening section that is provided to the container and that can fasten the protruding section;

the unlocking section is a projection portion that deforms the protruding section by contacting the protruding section;

when the developer cartridge is not inserted into the cartridge-inserted section, the protruding section is fastened by the fastening section; and when the developer cartridge is inserted into the cartridge-inserted section, the projection portion deforms the protruding section so that the fastening of the protruding section by the fastening section is released.

8. An image forming apparatus according to claim 6, wherein:

the developer cartridge is attached to the image-forming-apparatus body by rotationally moving the handle member to a predetermined position after the developer cartridge is inserted into the cartridge-inserted section;

the image forming apparatus includes a container-locking section that is for locking the container to the cartridge-inserted section; and the container-locking section includes a hook that is provided to the handle member, and that moves with rotational movement of the handle member, and a hole section that is provided in the cartridge-inserted section, and through which the hook can move when the developer cartridge is inserted into the cartridge-inserted section and through which the hook cannot move when the developer cartridge is attached to the image-forming-apparatus body.

9. An image forming apparatus, comprising:

a developer cartridge including a container for containing developer, the shutter device according to claim 1, including a sealing member that includes a second opening through which the developer can pass and a second shutter that opens and closes by moving linearly relative to the container between a second closing position at which the second shutter covers the second opening and a second opening position at which the second shutter exposes the second opening, a handle member that is supported so that the handle member can rotationally move relative to the container, and that includes a handle, and a conversion mechanism by which a rotational-movement force that rotationally moves the handle member is converted into a linear-movement force that linearly moves the second shutter;

a first opening that is provided opposing the second opening, and through which developer can pass; and a first shutter that is provided adjacent to the second shutter between the first opening and the second opening, and that opens and closes by moving between a first closing position at which the first shutter covers the first opening and a first opening position at which the first shutter exposes the first opening;

the second shutter including an operating section that engages with the first shutter and operates the first shutter, and whose engagement with the first shutter is disengaged at a certain point during at least either one of opening movement from the second closing position to the second opening position and closing movement from the second opening position to the second closing position.

10. An image forming apparatus, comprising:

a first opening and a second opening that are provided opposing each other, and through which developer can pass;

a first shutter and a second shutter that are provided adjacent to each other between the first opening and the second opening, the first shutter being capable of moving between a first closing position at which the first shutter covers the first opening and a first opening position at which the first shutter exposes the first opening, the second shutter being capable of moving between a second closing position at which the second shutter covers the second opening and a second opening position at which the second shutter exposes the second opening; and the shutter device according to claim 1, including one of the first shutter and the second shutter, the second shutter including an operating section that engages with the first shutter and operates the first shutter, and whose engagement with the first shutter is disengaged at a certain point during at least either one of opening movement from the second closing position to the second opening position and closing movement from the second opening position to the second closing position.

11. An image forming apparatus according to claim 10, wherein:

the image forming apparatus includes an image-forming unit that includes an image-bearing body for bearing a latent image, a containing section for containing developer, and a developer-bearing body for making the latent image borne by the image-bearing body visible using the developer as a developer image, and a developer cartridge that can be attached to and detached from the image-forming unit, and that is for supplying the containing section with the developer;

the first opening and the first shutter are provided to the image-forming unit; and the second opening and the second shutter are provided to the developer cartridge.

12. An image forming apparatus according to claim 11, wherein:

the operating section engages with the first shutter by elastic deformation of the operating section, and the operating section that engages with the first shutter is disengaged from the first shutter by elastic deformation of the operating section.

13. An image forming apparatus according to claim 12, wherein:

a longitudinal direction of the first shutter is along a longitudinal direction of the second shutter;

the operating section is an elastic metal piece that is located near both ends of the second shutter in its longitudinal direction;

the first shutter has an engaged-hole section with which the operating section can engage near both ends of the first shutter in its longitudinal direction;

the developer cartridge includes a protrusion that pushes the operating section so as to project towards the first shutter when the second shutter moves; and the operating section projects towards the first shutter and can engage with the engaged-hole section when being pushed by the protrusion, and does not project and cannot engage with the engaged-hole section when not being pushed by the protrusion.

14. An image forming apparatus according to claim 11, wherein:

the second shutter has a contacting section that can contact the first shutter when moving from the second closing position to the second opening position; and the first shutter moves from the first closing position to the first opening position as a result that the contacting section contacts and pushes the first shutter when the second shutter moves.

15. An image forming apparatus according to claim 14, wherein:

a longitudinal direction of the first shutter is along a longitudinal direction of the second shutter;

the contacting section is an extending section that extends towards the first shutter at one end in a transverse direction of the second shutter;

the first shutter has a projecting section that is located on a central section in the longitudinal direction of the first shutter and that projects towards the second shutter; and the first shutter moves from the first closing position to the first opening position as a result that the extending section contacts and pushes one end of the projecting section in a transverse direction of the first shutter when the second shutter moves.

16. An image forming apparatus, comprising:

a shutter device that prevents developer from spilling, the shutter device including:

a sealing member that includes an opening and that is compressible; and a shutter that includes an opening larger than an entire edge section of the opening of the sealing member, the sealing member being fixed to a wall member different from the shutter device in such a manner that an opening of the wall member opposes the opening of the sealing member, the sealing member being compressed between the wall member and the shutter at a position where the opening of the shutter and the opening of the sealing member oppose each other, and in a case where the shutter and an opposing member different from the shutter device are oppositely located, the entire edge section of the opening of the sealing member that opposes the opening of the shutter being capable of contacting the opposing member.

17. An image forming apparatus according to claim 16, wherein:

the image forming apparatus includes two of the shutter devices;

the two shutter devices are provided adjacent to each other in such a manner that the developer can move between the opening of the sealing member of one shutter device and the opening of the sealing member of the other shutter device in case that the opening of the shutter and the opening of the sealing member of each of the shutter devices are opposing each other; and the sealing members that are pressed by the respective shutters contact each other in case that the opening of the shutter and the opening of the sealing member of each of the shutter devices are opposing each other.

18. An image forming apparatus according to claim 17, wherein:

the edge sections around the respective openings of the respective sealing member that are pressed by the respective shutters are sandwiched between the two shutters in case that the opening of the shutter and the opening of the sealing member of each of the shutter devices are opposing each other.

19. An image forming apparatus according to claim 17, wherein:

the two shutter devices are a first shutter device provided to an image-forming unit that includes an image-bearing body for bearing a latent image, a containing section for containing developer, and a developer-bearing body for making the latent image borne by the image-bearing body to be visible as a developer image using the developer, and a second shutter device provided to a developer cartridge that can be attached to and detached from the image-forming unit, and that supplies the containing section with the developer.

20. An image forming apparatus according to claim 19, wherein:

the shutter of the first shutter device includes a contacting section that contacts the shutter of the second shutter device when the shutter of the first shutter device moves from a closing position at which the opening of the sealing member is closed to an opposing position at which the opening of the shutter and the opening of the seal member oppose each other; and when the shutter of the first shutter device moves from the opposing position to the closing position, the contacting section does not reach a position opposite to the opening of the sealing member of the first shutter device.

* * * * *